US006733100B1

(12) United States Patent
Fujita et al.

(10) Patent No.: US 6,733,100 B1
(45) Date of Patent: May 11, 2004

(54) PRINTING APPARATUS, CONTROL METHOD THEREFOR, AND COMPUTER-READABLE MEMORY

(75) Inventors: Miyuki Fujita, Tokyo (JP); Hiroshi Tajika, Yokohama (JP); Yuji Konno, Kawasaki (JP); Norihiro Kawatoko, Kawasaki (JP); Tetsuya Edamura, Kawasaki (JP); Tetsuhiro Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/640,085

(22) Filed: Aug. 17, 2000

(30) Foreign Application Priority Data

Aug. 24, 1999 (JP) ..... 11-237521

(51) Int. Cl.[7] ..... B41J 29/38
(52) U.S. Cl. ..... 347/12; 347/19
(58) Field of Search ..... 347/12, 19, 40, 347/41, 43

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 5,049,898 | A | * | 9/1991 | Arthur et al. | 347/19 |
| 5,124,720 | A | * | 6/1992 | Schantz | 347/19 |
| 5,898,443 | A | | 4/1999 | Yoshino et al. | 347/19 |
| 6,010,205 | A | * | 1/2000 | Billet | 347/40 |
| 6,036,300 | A | | 3/2000 | Suzuki et al. | 347/41 |
| 6,203,140 | B1 | * | 3/2001 | Oyen | 347/41 |
| 6,215,557 | B1 | * | 4/2001 | Owens | 358/1.14 |
| 6,267,463 | B1 | * | 7/2001 | Paulsen et al. | 347/19 |
| 6,270,187 | B1 | * | 8/2001 | Murcia et al. | 347/43 |
| 6,271,928 | B1 | * | 8/2001 | Bullock et al. | 358/1.16 |
| 6,278,469 | B1 | * | 8/2001 | Bland et al. | 347/19 |
| 6,283,572 | B1 | * | 9/2001 | Kumar et al. | 347/19 |
| 6,302,511 | B1 | | 10/2001 | Neese et al. | 347/19 |
| 6,398,342 | B1 | | 6/2002 | Neese et al. | 347/40 |
| 6,447,090 | B1 | * | 9/2002 | Saruta | 347/19 |

FOREIGN PATENT DOCUMENTS

| | | | | |
|---|---|---|---|---|
| EP | 631 870 | A2 * | 1/1995 | B41J/2/16 |
| EP | 709 213 | A2 * | 1/1996 | B41J/2/195 |
| EP | 0 863 004 | | 9/1998 | |
| EP | 0 901 098 | | 3/1999 | |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 61-123545 | | 6/1986 | |
| JP | 5-309874 | | 11/1993 | |
| JP | 6-320732 | | 11/1994 | |
| JP | 10-258526 | | 9/1998 | |
| JP | 11-988 | | 1/1999 | |
| JP | 11-77986 | | 3/1999 | |

* cited by examiner

*Primary Examiner*—Juanita Stephens
*Assistant Examiner*—Blaise Mouttet
(74) *Attorney, Agent, or Firm*—Fitzpatrick, Cella, Harper & Scinto

(57) ABSTRACT

At least defective printing element information about a defective printing element among a plurality of printing elements is stored in an EEPROM. A complementary printing element for masking printing data corresponding to the defective printing element indicated by the defective printing element information and complementarily printing the printing data corresponding to the defective printing element is determined. The printing data of the defective printing element is printed using the determined complementary printing element.

11 Claims, 25 Drawing Sheets

CONNECT APPARATUS TO POWER SUPPLY
FIRST INITIALIZATION
S1
1
S2
NO
POWER KEY ON INPUT CHECK?
YES
SECOND INITIALIZATION
S3
2
S4
WAIT FOR EVENT?
PRINT COMMAND RECEPTION
POWER KEY OFF INPUT
ANOTHER EVENT INPUT
S10
S11
S5
COMMAND ANALYSIS
PRINTER TERMINATION PROCESS
EVENT PROCESSING
S6
PAPER FEED
1
2
S7
PRINT
S8
PAPER DELIVERY
S9
NO
ARE ALL PAGES COMPLETELY PRINTED?
YES
2

PRINTING APPARATUS, CONTROL METHOD THEREFOR, AND COMPUTER-READABLE MEMORY

FIELD OF THE INVENTION

The present invention relates to a printing apparatus for performing printing using a printhead with a plurality of printing elements, a control method therefor, and a computer-readable memory.

Note that the present invention is applicable not only to a general printing apparatus but also to a copying machine, a facsimile apparatus having a communication system, a word processor having a printing unit, and an industrial printing apparatus combined with various processors.

BACKGROUND OF THE INVENTION

Serial-scan printing apparatuses for printing data while scanning a printing medium with a printhead are applied to formation of various images. Particularly, inkjet printing apparatuses are rapidly being spread because of higher resolution, advanced color printing, and higher image quality in recent years.

Such a printing apparatus prints an image at a higher resolution by decreasing the ink discharge amount per dot while increasing the integration density of nozzles for discharging ink droplets. To realize an image quality equivalent to a silver halide photograph, various techniques have been developed such that printing is done simultaneously using four basic color inks (cyan, magenta, yellow, and black), and light inks prepared by decreasing the ink concentrations of these basic color inks. As the ink concentrations are related to image density, the ink concentrations will also be hereinafter referred to as ink densities. The printing speed, which may decrease for higher image quality, can be increased by increasing the number of printing elements and the driving frequency, and using a printing technique such as two-way printing of performing printing in reciprocal scans of a printhead.

In a printhead containing many printing elements, a defective printing element (to be also referred to as a defective channel hereinafter) is generated over time in accordance with the use frequency. As the number of printing elements aligned at a high integration density increases, the probability of generating defective printing elements in manufacturing a head also increases. If an integrated structure for a plurality of colors is adopted to prevent color misregistration and improve the operability, this probability further increases. Although most printing elements are nondefective, even one defective printing element degrades the image quality. Importantly, such a printhead cannot be used for the recently required application of printing photographic images.

There have already been proposed many methods in response, including various defective printing element detection methods, and recovery methods or printing methods corresponding to the detection results. Such methods in printing when a defective printing element exists are disclosed in Japanese Patent Laid-Open Nos. 5-309874, 61-123545, 11-988, 11-77986, and 10-258526.

Japanese Patent Laid-Open No. 5-309874 discloses a method of setting the number of multipass printing operations in accordance with image data to be printed, the presence/absence of a defective printing element, and the type of image because image degradation by a defective printing element is reduced by multipass printing of printing an image while scanning a predetermined region of the image by a printhead a plurality of number of times.

However, even if the number of scan operations (passes) in multipass printing is increased, the influence of a defective printing element on an image stands out as a stripe on a high-quality photographic image, an application which has been in demand more and more in recent years. To obtain a higher image quality, the number of passes must be greatly increased. From the two points, the invention discloses in the above reference cannot be practically used.

Japanese Patent Laid-Open No. 61-123545 discloses a method of printing image data of a defective channel by a nondefective channel mainly in 1-pass printing of a predetermined region of an image by one scanning of a printhead. When a carriage prints data to the right, normal printing is done. When the carriage moves to the left, a sheet is fed by an integral multiple of one pixel for the purpose of complementary printing of a pixel by a nondefective printing element which cannot be printed by a defective printing element. That is, a defective channel is complemented by a nondefective channel. This method completely complements image data, but assumes 1-pass printing. Thus, the method cannot cope with a color mode in which a high-quality photographic image is printed, which is an object of the present invention. The original printing method is 1-pass printing, but alternate printing is substantially 2-pass printing in which the throughput is low.

Japanese Patent Laid-Open No. 11-77986 discloses a method of counting the use frequency of a complementary nozzle, and when the total use frequency reaches a predetermined value, sequentially switching complementary nozzles in consideration of the service life of each complementary nozzle on the complementary printing side. Similar to Japanese Patent Laid-Open No. 61-123545, this method assumes 1-pass printing and cannot cope with a color mode in which a high-quality photographic image is printed, which is an object of the present invention.

Japanese Patent Laid-Open No. 11-988 discloses an arrangement in which n/m printing elements prepared by dividing n printing elements by m (the divisor of the number of nozzles) are set as first printing elements used for a normal printing scan. Other n(m−1)/m printing elements are set as second printing elements not used for the normal printing scan, and the printing operation is effected using a second printing element as an alternate printing element only when a first printing element is defective. This arrangement basically assumes a multipass printing method of completing an image by repeating the printing scan and sheet feeding m times for a single image region. This method can complement an image without decreasing the throughput. However, this printing method (generally called interlaced printing) is one in which an image of one line in the carriage scan direction is completed by one printing scan with one printing element.

Japanese Patent Laid-Open No. 10-258526 assumes multipass printing, similar to Japanese Patent Laid-Open No. 5-309874, and discloses a method of complementing omitted data of one nozzle by another nozzle. After a standard mask is obtained prior to printing, a defective nozzle is specified, and an alternate exchange nozzle is selected in accordance with the position of the defective nozzle. Printing data of the defective nozzle is erased from its mask, and added to the mask of the exchange nozzle. This method can print an image without decreasing the throughput, even in a color mode in which a high-quality photographic image is printed, which is an object of the present invention.

As printers are becoming more for personal use and smaller in size, cartridge-type printheads or ink tanks are becoming popular. Printhead or ink tanks are individually different in their manufacture or practical use. This occurs due to different driving methods of discharging proper amounts of ink droplets, or due to concerns about the remaining ink amount in an ink tank which has already been used by another main body. Information about the cartridge characteristics is effectively stored not in a printing apparatus, but in each printhead or ink tank. This is because a plurality of cartridges are mounted/dismounted on/from a plurality of main bodies. From this, Japanese Patent Laid-Open No. 6-320732 discloses that an EEPROM is mounted on a board constituting a printhead, the EEPROM stores information about the characteristics of the printhead such as printhead driving conditions or density unevenness correction data, or information about the printing history such as the number of printed sheets or the number of discharge operations, and driving conditions and the like are updated in accordance with the information. In practice, many printing apparatuses employ this arrangement.

However, each conventional method in printing when a defective printing element exists suffers a problem such that either the complement is imperfect, the throughput decreases, or the complementary load concentrates on one nozzle. Even in the complementing method disclosed in Japanese Patent Laid-Open No. 10-258526, which assumes multipass printing, the number of complementary candidates increases, but either the discharge load is double the normal discharge load or continuous driving is concentrated on one nozzle in actual printing. For this reason, this method is not the most preferable complementing method in terms of the service lives of the nozzle and printhead.

SUMMARY OF THE INVENTION

The present invention has been made to overcome the conventional drawbacks, and has as its object to provide a printing apparatus for realizing stable, efficient printing, a control method therefor, and a computer-readable memory.

A printing apparatus according to the present invention for achieving the above object has the following arrangement. A printing apparatus for performing printing using a printhead with a plurality of printing elements is characterized by comprising storage means for storing at least defective printing element information about a defective printing element among the plurality of printing elements, determination means for determining a complementary printing element for masking printing data corresponding to the defective printing element indicated by the defective printing element information and complementarily printing the printing data corresponding to the defective printing element, and printing means for printing the printing data of the defective printing element using the complementary printing element determined by the determination means.

A control method for a printing apparatus according to the present invention for achieving the above object has the following steps. A control method for a printing apparatus for performing printing using a printhead with a plurality of printing elements is characterized by comprising the determination step of referring to a storage medium which stores at least defective printing element information about a defective printing element among the plurality of printing elements, and determining a complementary printing element for masking printing data corresponding to the defective printing element indicated by the defective printing element information and complementarily printing the printing data corresponding to the defective printing element, and the printing step of printing the printing data of the defective printing element using the complementary printing element determined in the determination step.

A computer-readable memory according to the present invention for achieving the above object has the following program codes. A computer-readable memory storing program codes of control of a printing apparatus for performing printing using a printhead with a plurality of printing elements is characterized by comprising a program code of the determination step of referring to a storage medium which stores at least defective printing element information about a defective printing element among the plurality of printing elements, and determining a complementary printing element for masking printing data corresponding to the defective printing element indicated by the defective printing element information and complementarily printing the printing data corresponding to the defective printing element, and a program code of the printing step of printing the printing data of the defective printing element using the complementary printing element determined in the determination step.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Embodiments according to a printing apparatus of the present invention will be described below with reference to the accompanying drawings.

In the embodiments to be explained below, a printing apparatus using an inkjet printing system will be described using a printer as an example.

In this specification, the term "print" is used to mean not only to form significant information such as characters and graphics, but also to form, e.g., images, figures, and patterns on printing media in a broad sense, regardless of whether the information formed is significant or insignificant or whether the information is visualized so that a human can visually perceive it, or is used to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[Apparatus Main Body]

Figure 1:
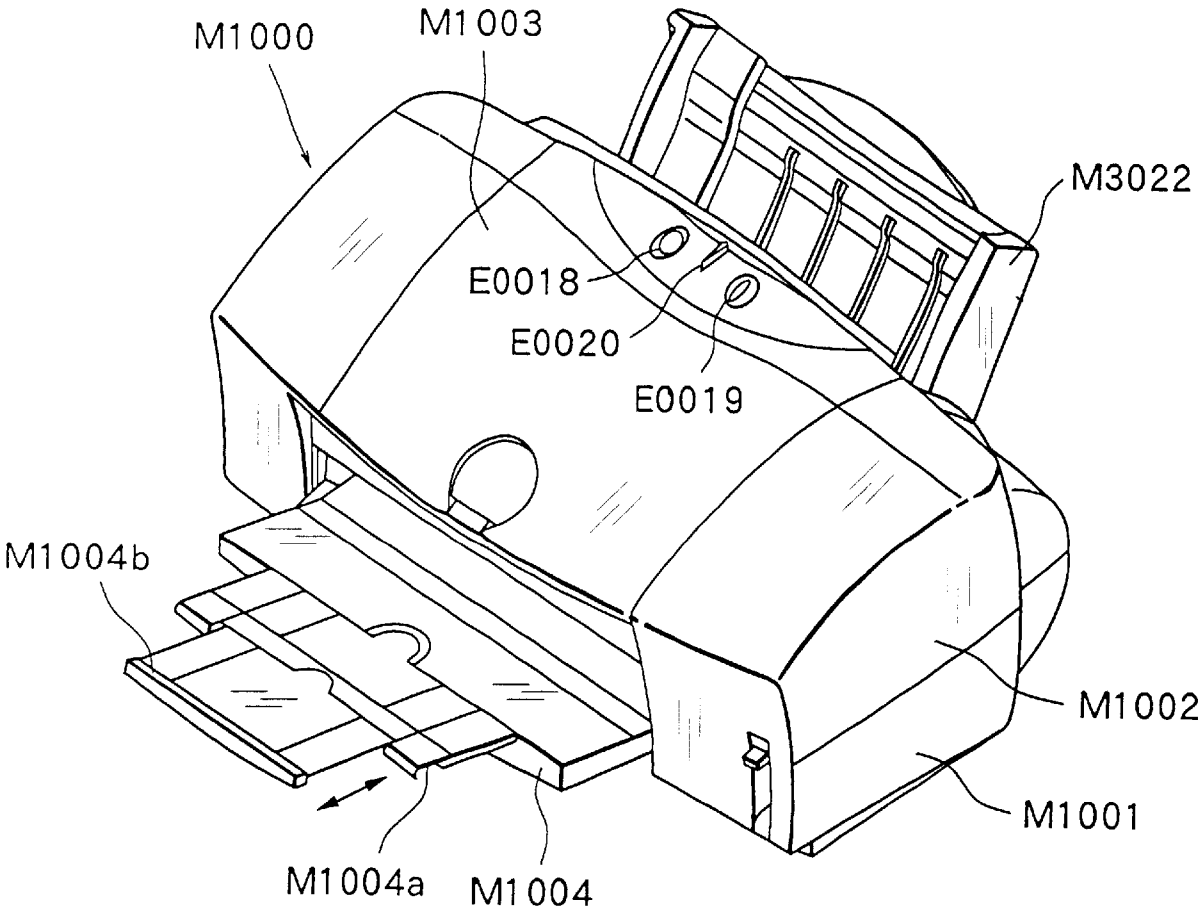
FIG. 1 is a perspective view showing the external appearance of an inkjet printer according to an embodiment of the present invention.
Figure 2:
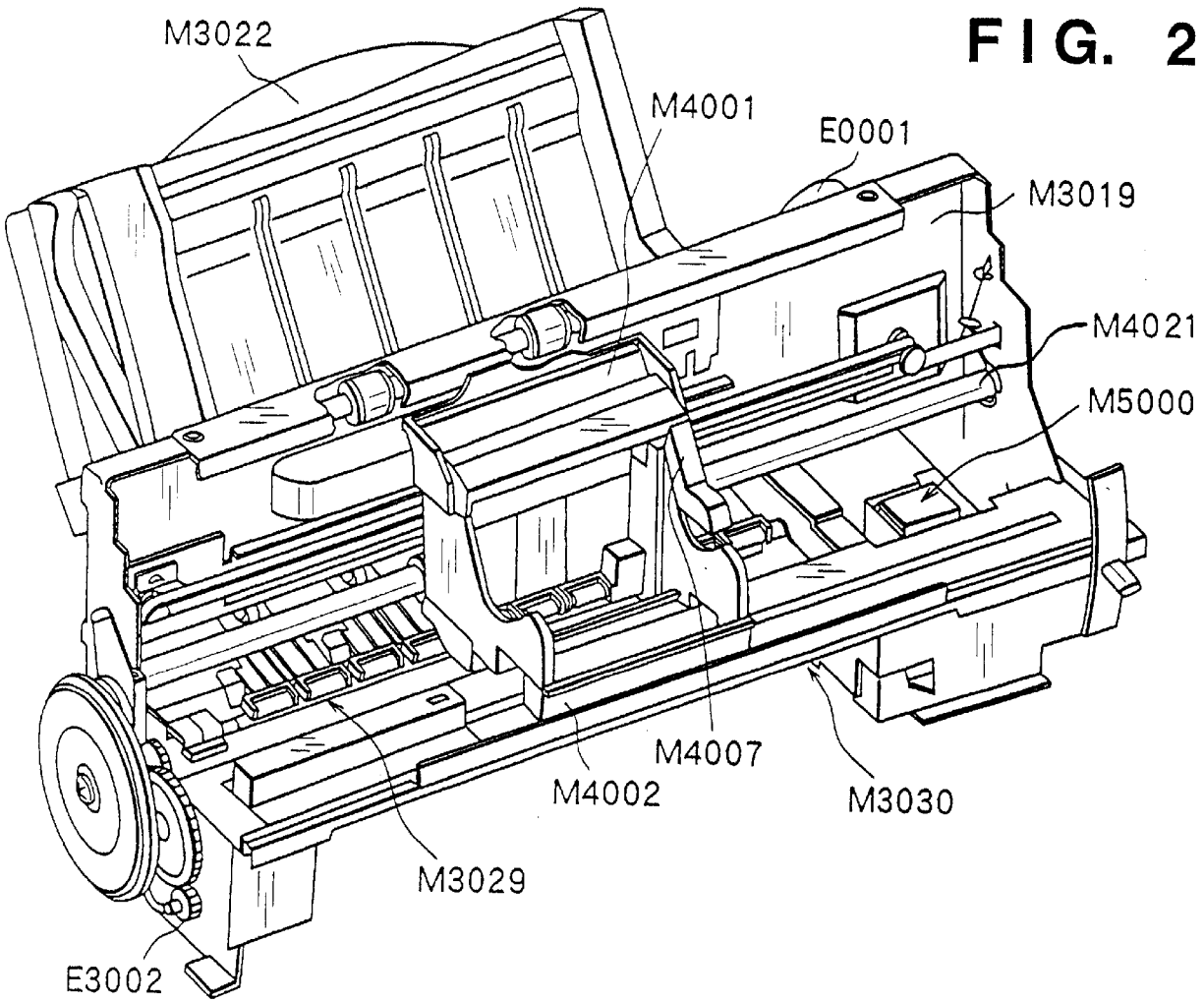
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 substantially forms the lower half of the apparatus main body M1000, and the upper case M1002 substantially forms the upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased a reduced in three increments.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
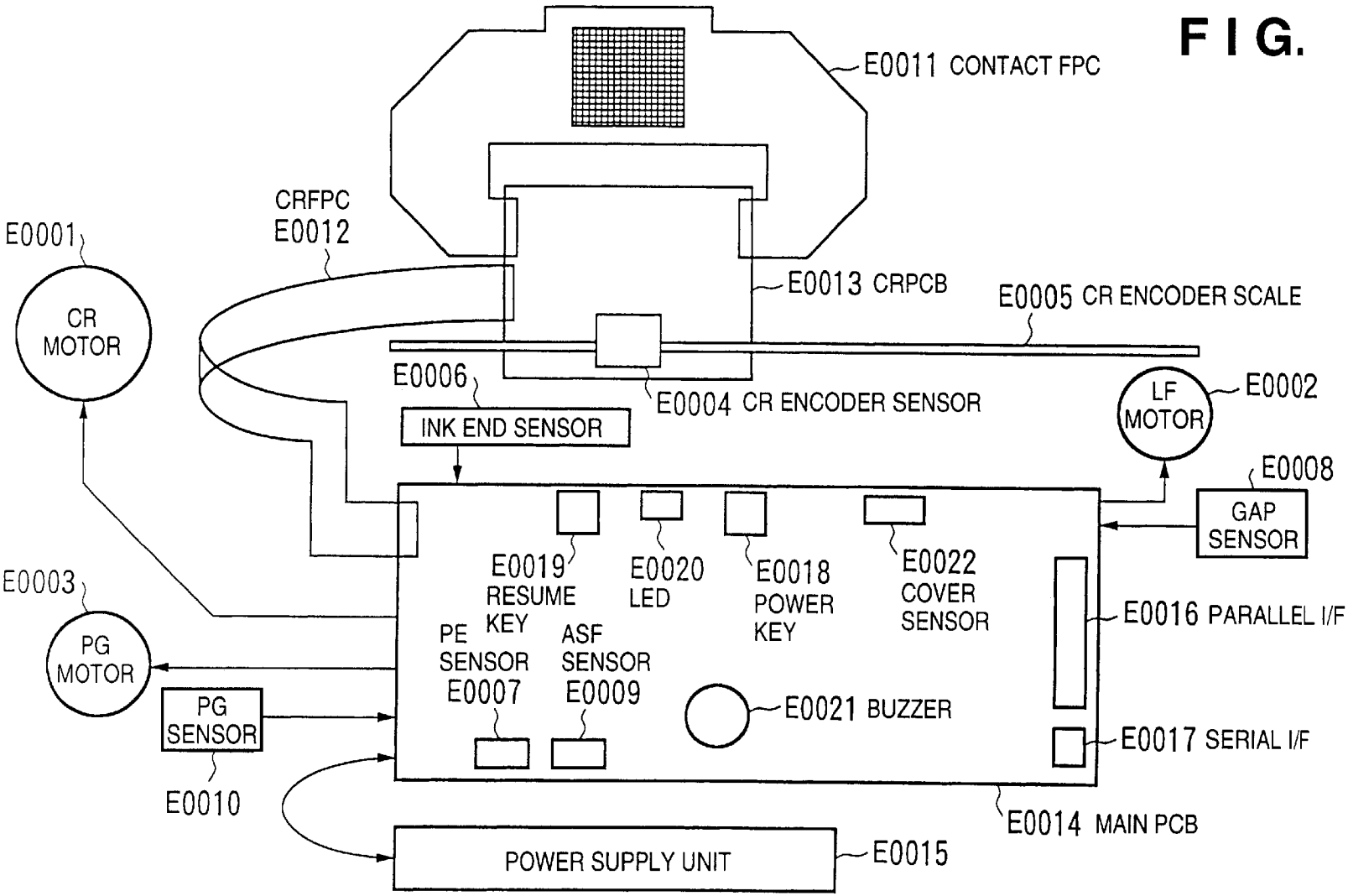
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

[Printing Mechanisms]

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

(Printing Unit)

The printing unit will be described below.

This printing unit includes a carriage M4001 movably supported by a carriage shaft M4021, and the printhead cartridge H1000 detachably mounted on this carriage M4001.

Printhead Cartridge

First, the printhead cartridge will be described with reference to FIGS. 3 to 5.

Figure 3:
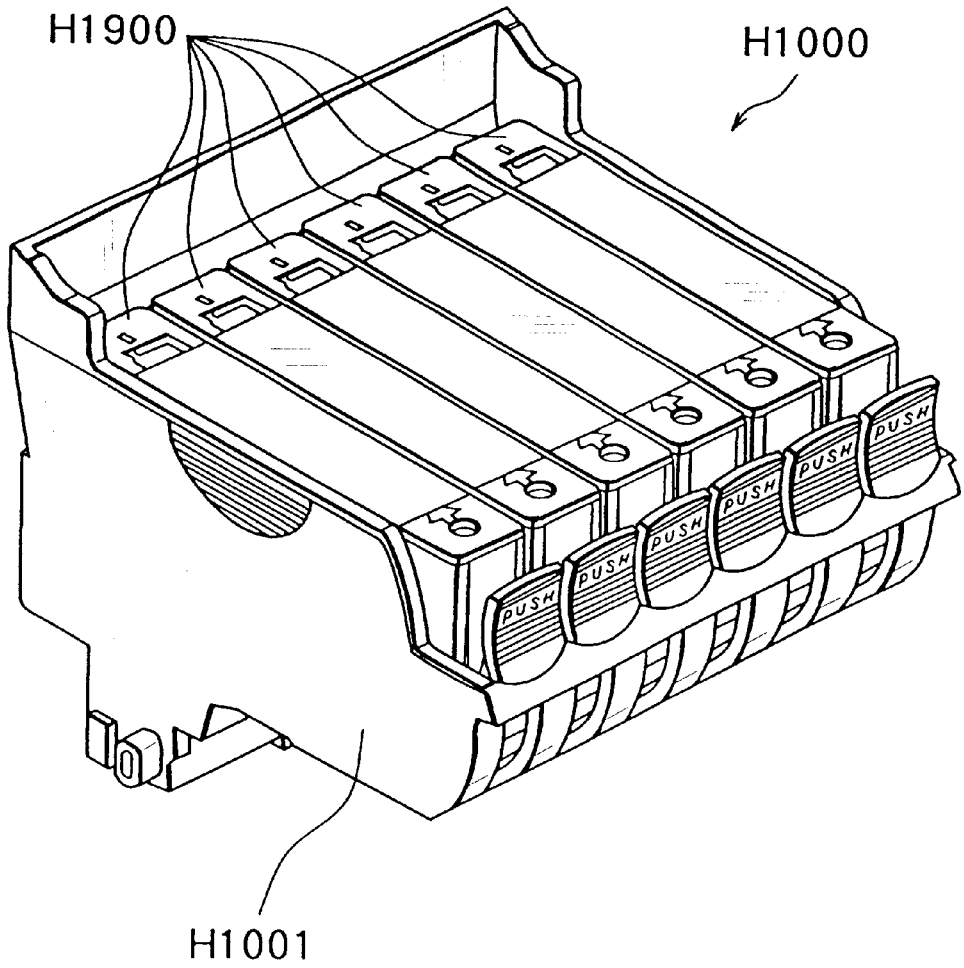
FIG. 3 is a perspective view showing a printhead cartridge used in the embodiment of the present invention.
Figure 4:
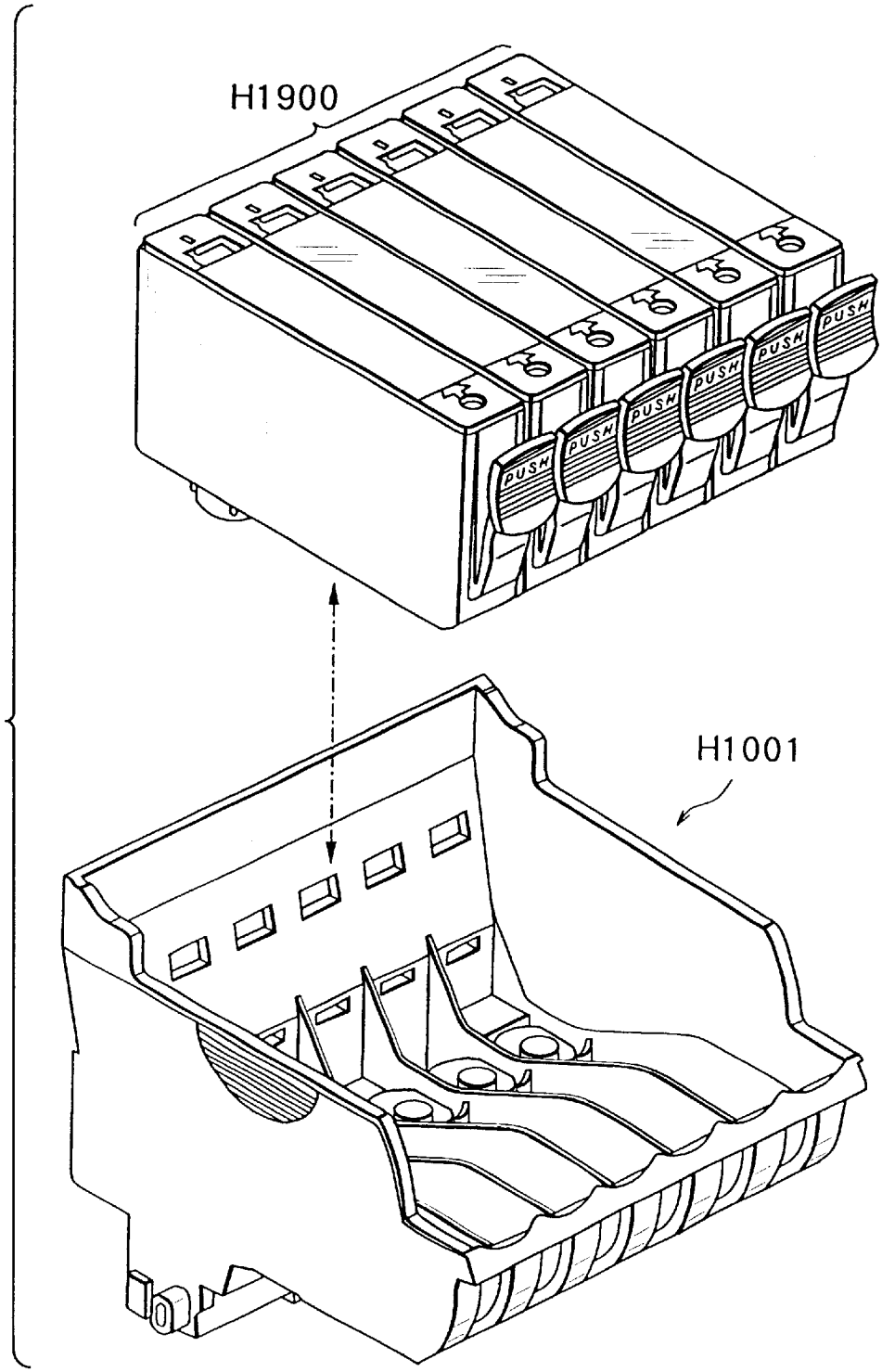
FIG. 4 is a perspective view showing how the printhead cartridge shown in FIG. 3 is assembled.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
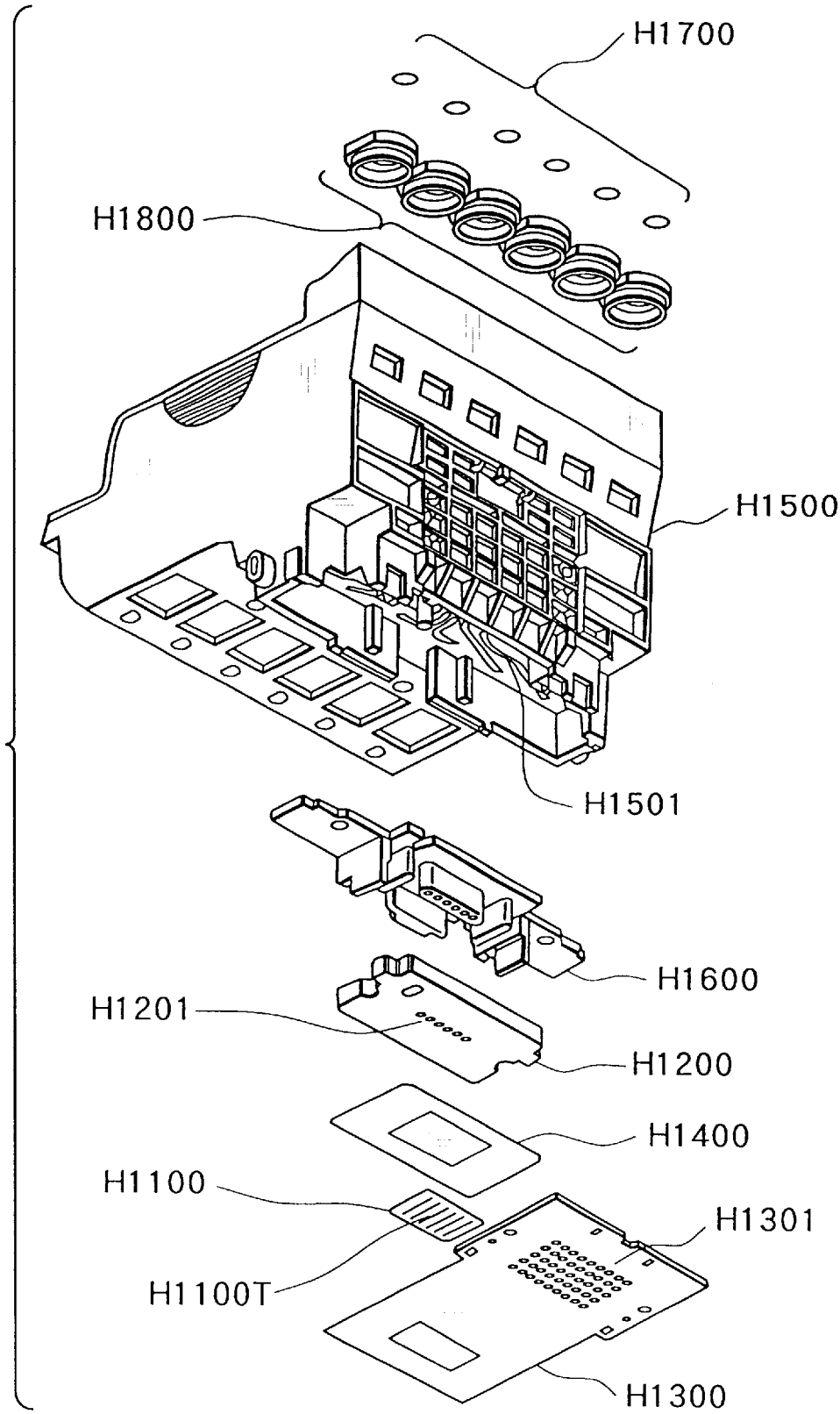
FIG. 5 is an exploded perspective view showing the components of the printhead shown in FIG. 3 as viewed from below.

As shown in an exploded perspective view of FIG. 5, the printhead H1001 comprises a printing element board H1100, first plate H1200, electrical printed circuit board H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply ports for supplying ink to these ink channels are formed in the rear surface. This printing element board H1100 is fixed to the first plate H1200 by adhesion. Ink supply ports H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

(Carriage)

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

[Scanner]

The printer of this embodiment is also usable as a reading apparatus by replacing the printhead with a scanner.

This scanner moves together with the carriage of the printer and reads an original image, instead of printing on a medium, in a sub-scan direction. Information from one original image is read by alternately performing the read operation and the original feed operation.

Figure 6B:
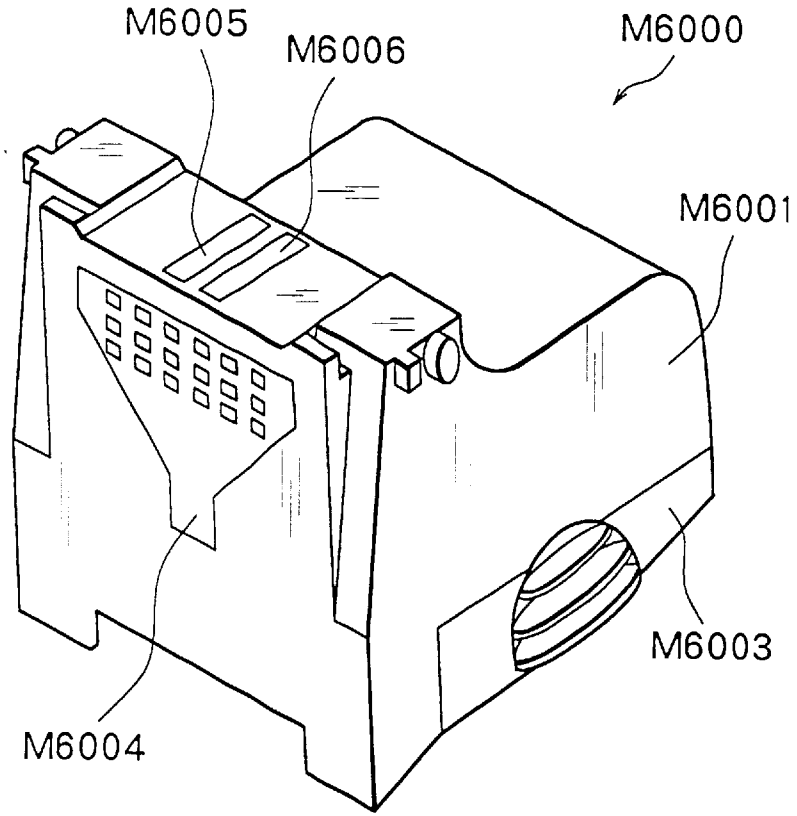
FIGS. 6A and 6B are perspective views showing a scanner cartridge in the embodiment of the present invention.
Figure 6A:
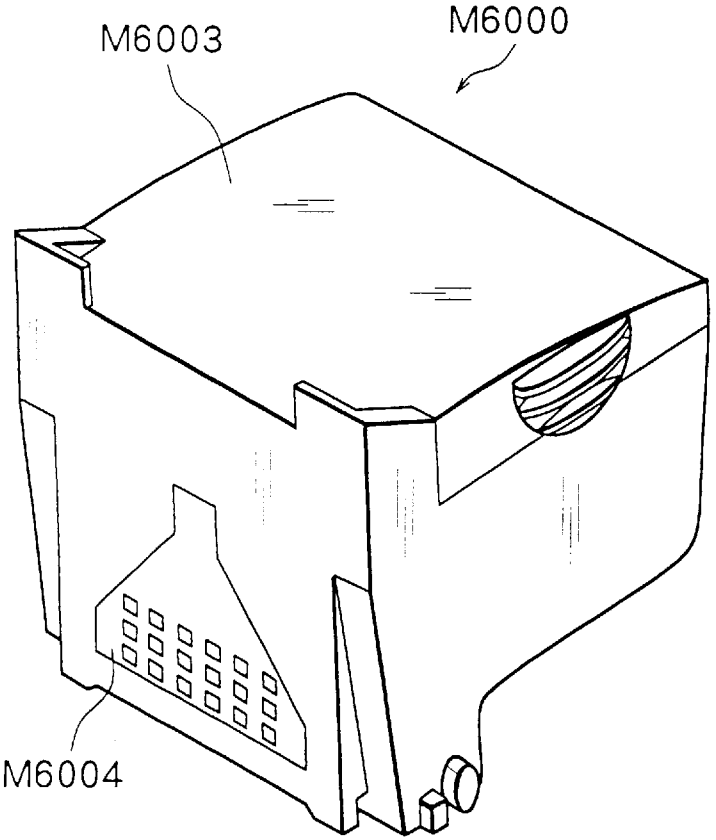

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
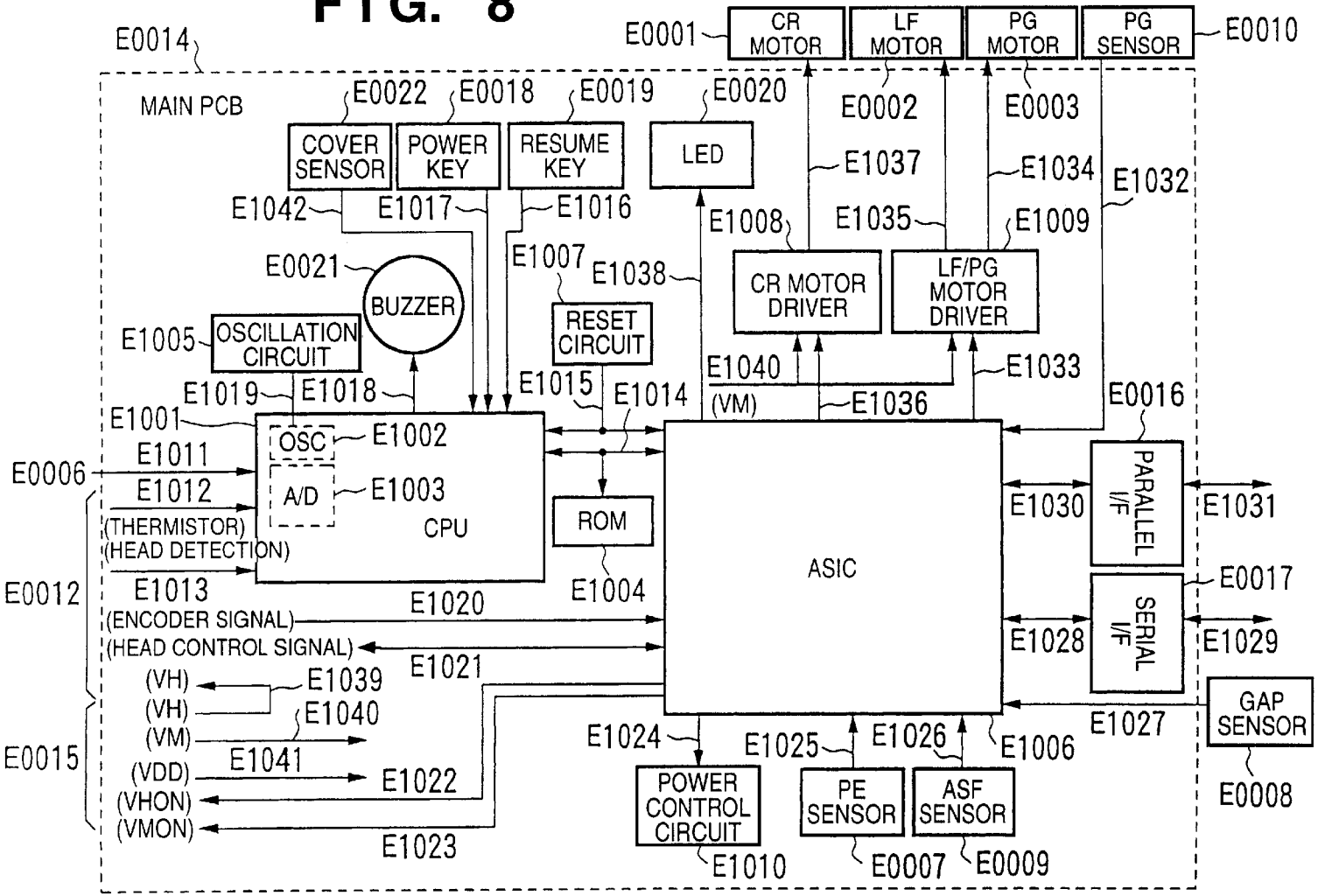
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HSENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, the motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

The ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E0016 and the serial I/F E0017. Also, the ASIC E1006 senses the statuses of a PE sensing signal (PES) E1025 from the PE sensor E0007, an ASF sensing signal (ASFS) E1026 from the ASF sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

Figure 9:
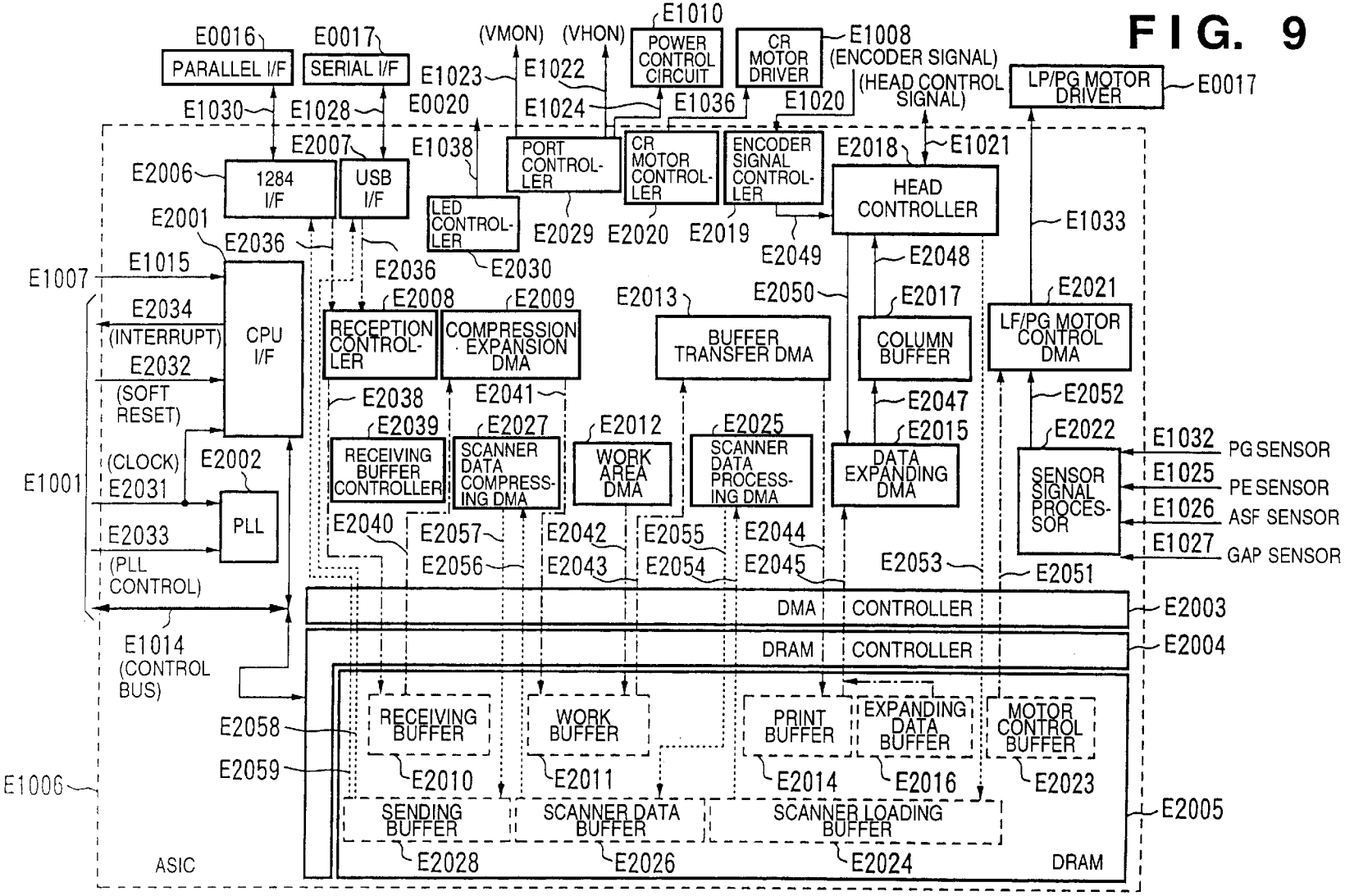
FIG. 9 is a block diagram showing the internal arrangement of an ASIC shown in FIG. 8.

FIG. 9 is a block diagram showing the internal arrangement of the ASIC E1006.

Referring to FIG. 9, only flows of data, such as printing data and motor control data, pertaining to control of the head and each mechanical part are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the ASIC E1006, in accordance with a clock signal (CLK) E2031 and PLL control signal (PLLON) E2033 output from the CPU E1001.

A CPU interface (CPU I/F) E2001 controls reading and writing to a register in each block (to be described below), supplies clock to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of an interrupt generated in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between allowing access from the CPU E1001 to the DRAM E2005 through the control bus and allowing access from a DMA controller E2003 (to be described below) to the DRAM E2005, thereby performing read and write to the DRAM E2005.

The DMA controller E2003 accepts a request (not shown) from each block and outputs to the RAM controller an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has transmitted a read request.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by DMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2026 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the abovementioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
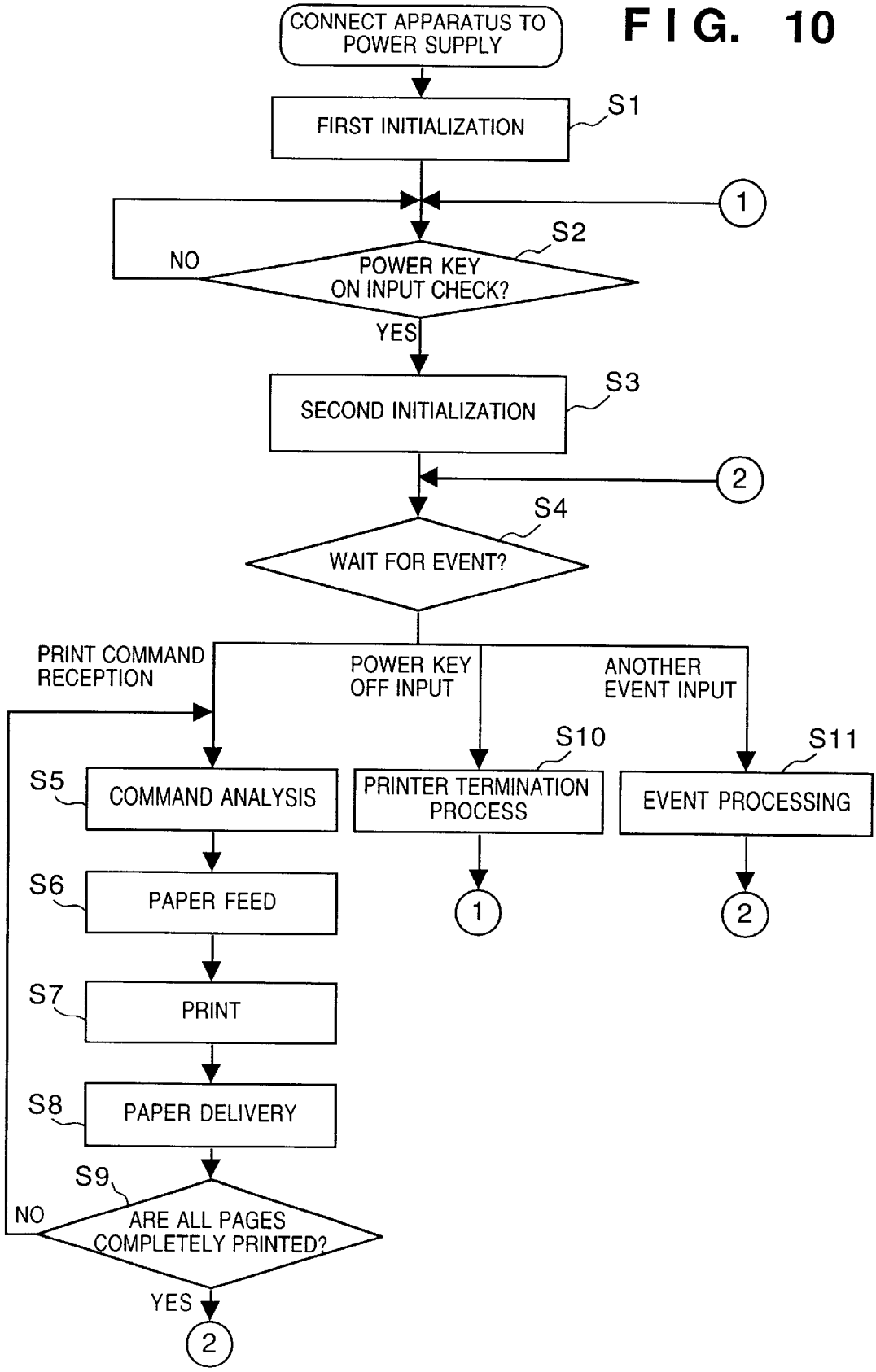
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step Sl first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

<First Embodiment>

The nozzle arrangement of a printhead in the first embodiment will be described with reference to FIG. 11.

Figure 11:
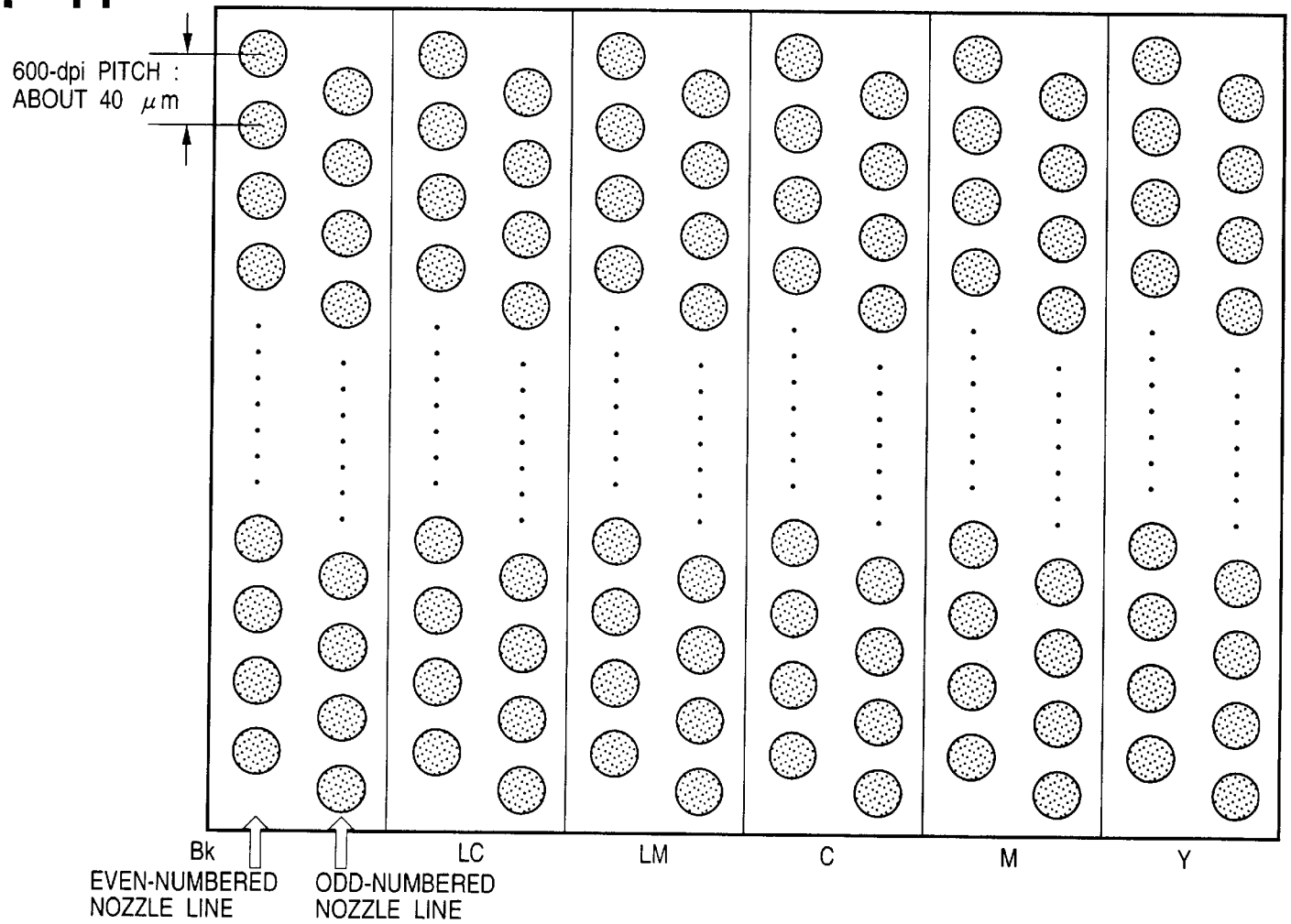
FIG. 11 is a plan view showing the nozzle arrangement of a printhead in the first embodiment.

FIG. 11 is a plan view showing the nozzle arrangement of the printhead in the first embodiment.

In the first embodiment, a printhead of each color realizes a resolution of 1,200 dpi by shifting two nozzle lines, each having 128 nozzles (for a total of 256 nozzles), from each other (by about 21.2 $\mu$m) at a pitch (about 42.3 $\mu$m) corresponding to the resolution of 600 dpi. To differentiate between the two nozzle lines arranged on a printhead of each color, a line on which odd-numbered nozzles are aligned will be called an odd-numbered nozzle line, and a line on which even-numbered nozzles are aligned will be called an even-numbered nozzle line. Such nozzle lines of six colors are arranged in parallel with each other, as shown in FIG. 11. The integrated 12 lines realize printing of six colors at 1,200 dpi. In the manufacture, nozzle lines of two colors are simultaneously formed as one chip, and three chips are adhered in parallel with each other. Adjacent chips (Black (Bk) & Light Cyan (LC) chips, Light Magenta (LM) & Cyan (C) chips, and Magenta (M) & Yellow (Y) chips) have similar driving conditions, compared to the remaining chip.

The structure of a board mounted in the printhead will be explained with reference to FIG. 12.

Figure 12:
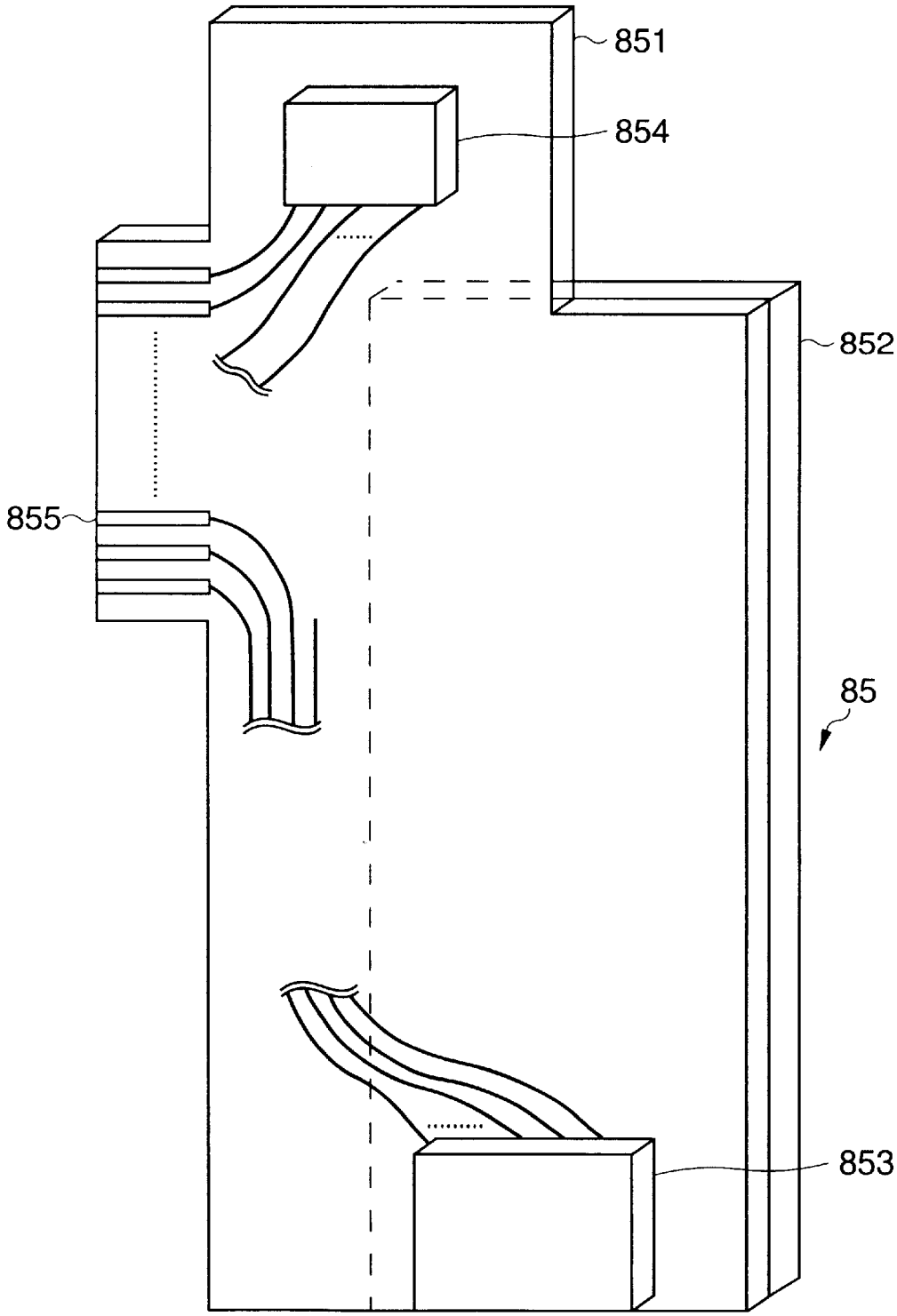
FIG. 12 is a view showing the structure of a board mounted in the printhead in the first embodiment.

FIG. 12 is a view showing the structure of the board mounted in the printhead in the first embodiment.

In FIG. 12, reference numeral 851 denotes a printed board; 852, an aluminum heat dissipation plate; 853, a heater board made up of a heating element and diode matrix; and 854, a nonvolatile memory such as an EEPROM storing head information about a printhead. These components may take other forms, as needed. Reference numerals 855 denote contact electrodes. FIG. 12 does not show discharge orifices arranged in line.

The EEPROM 854 for storing head information is mounted in the printhead. When the printhead is mounted on a main body apparatus, the main body apparatus can read head information from the printhead to perform predetermined control based on the information. This can ensure high image quality.

The memory contents of the EEPROM 854 in the first embodiment will be explained with reference to FIG. 13.

Figure 13:
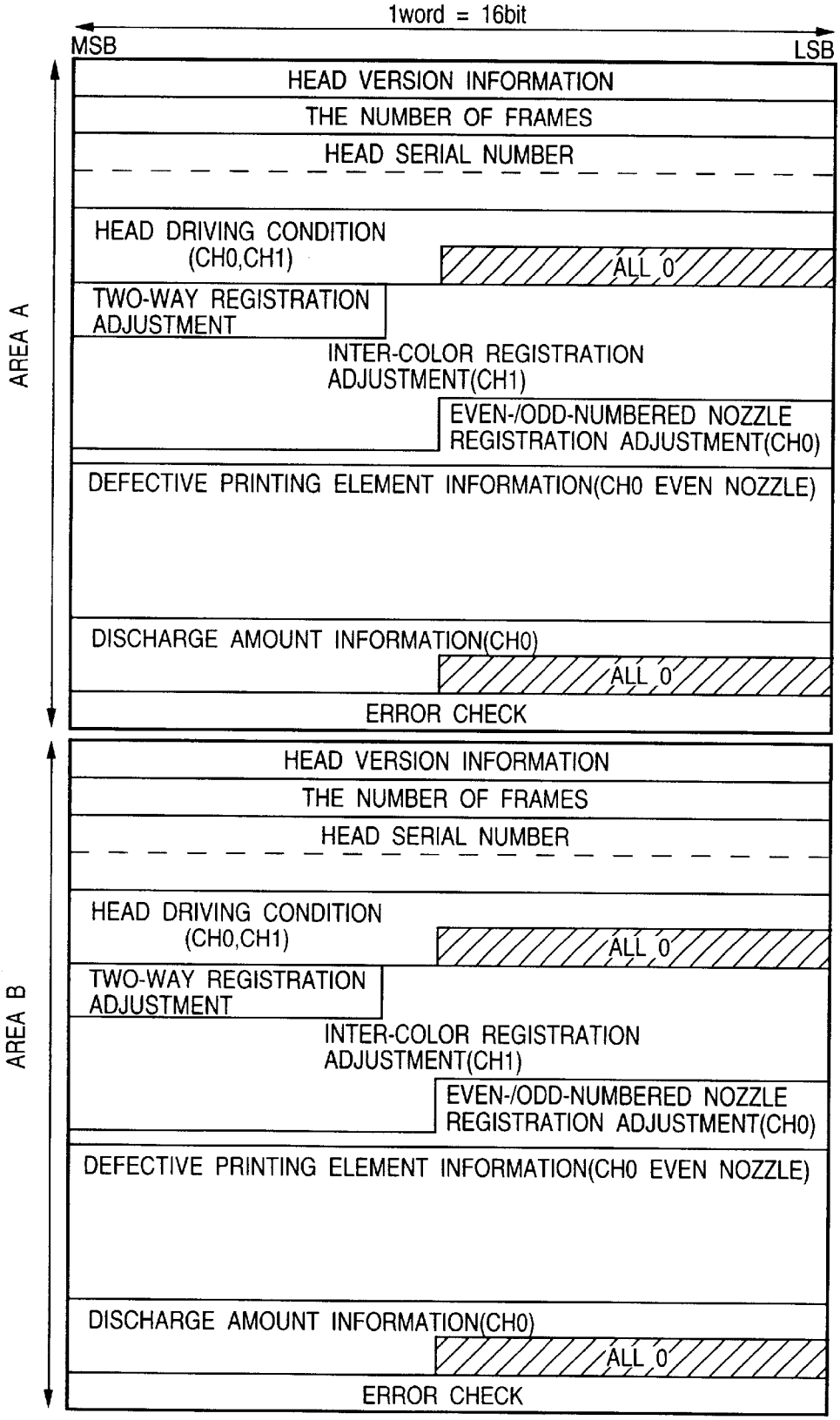
FIG. 13 is a view showing the memory contents of an EEPROM in the first embodiment.

FIG. 13 is a view showing the memory contents of the EEPROM in the first embodiment.

The EEPROM 854 has a capacity of total 1 kbit=63 words, and stores the following items and contents as head information about the printhead.

Head version information (1 word): information for coping with changes in driving conditions upon upgrading The number of frames used for the memory (1 word): prevention of any read error of memory contents Head serial number (1 word): information used to discriminate respective printheads Head driving conditions (8 bits×3 chips): information for selecting a proper driving pulse for each chip Two-way registration adjustment data (4 bits): printing position correction values in forward-path printing and return-path printing Inter-color registration adjustment data (4 bits×5 colors): printing position correction value for Bk between respective colors Even-/odd-numbered nozzle registration adjustment data (4 bits×6 colors): printing position correction value between even- and odd-numbered lines of each color Defective printing element information (4 bits×12 lines): positional information of defective nozzle in each line Discharge amount information (4 bits×6 colors): level of printing discharge amount of each color Error check (1 word)

To prevent a head information acquisition error, the first embodiment stores the same contents in area A=area B in the single EEPROM 854.

A "defective printing element" in the first embodiment means a nozzle which fails in normal printing, and includes an undischargeable nozzle and a deviated discharge nozzle which prints data at a position greatly shifted from a correct position. The "undischargeable nozzle" means a nozzle which does not discharge any ink even after a driving pulse is applied. The "deviated discharge nozzle" means a nozzle which discharges ink at a greatly deviated landing position with respect to other nozzles, and degrades an image.

In the first embodiment, the EEPROM 854 of the printhead stores as head information defective printing element information about a defective printing element which has existed since the manufacture. In actual printing, printing operation is controlled based on the defective printing element information to complete printing without influencing an image and the printing speed.

For example, when the 15th nozzle of an even-numbered Bk nozzle line is found to be undischargeable in shipment from the factory, 0X0F (00001111) is stored at its address (8 bit). When the 64th nozzle of an odd-numbered nozzle line is found to be a deviated discharge nozzle, 0X40 (01000000) is stored at its address, and 0X80 (10000000) is stored for the remaining nozzles. As a representation method for defective printing element information, the most significant bit represents whether a defective nozzle exists on a nozzle line. The most significant bit is 0 if merely one nozzle is defective, and 1 if no nozzle is defective. The remaining 7 bits represent the position of a defective printing element, and indicate nozzle numbers 0 to 127 from the top. This method suffices to the first embodiment because only one nozzle is permitted as a defective printing element per line, and does not discriminate a deviated discharge nozzle from an undischargeable nozzle.

The contents of the EEPROM 854 containing defective printing element information are copied to the EEPROM of a main body apparatus under the control of the main body apparatus when a head unit is delivered to the user and turned on while being mounted in the main body. As far as the head serial number stored in the main body in power-on operation coincides with that of the EEPROM 854, the contents of the EEPROM 854 of the printhead need not be copied, and are processed and controlled by the main body.

A case wherein the 15th nozzle of an even-numbered black nozzle line is an undischargeable nozzle, and the 65th nozzle of an odd-numbered nozzle line is a deviated discharge nozzle will be described by exemplifying two printing modes.

Figure 14:
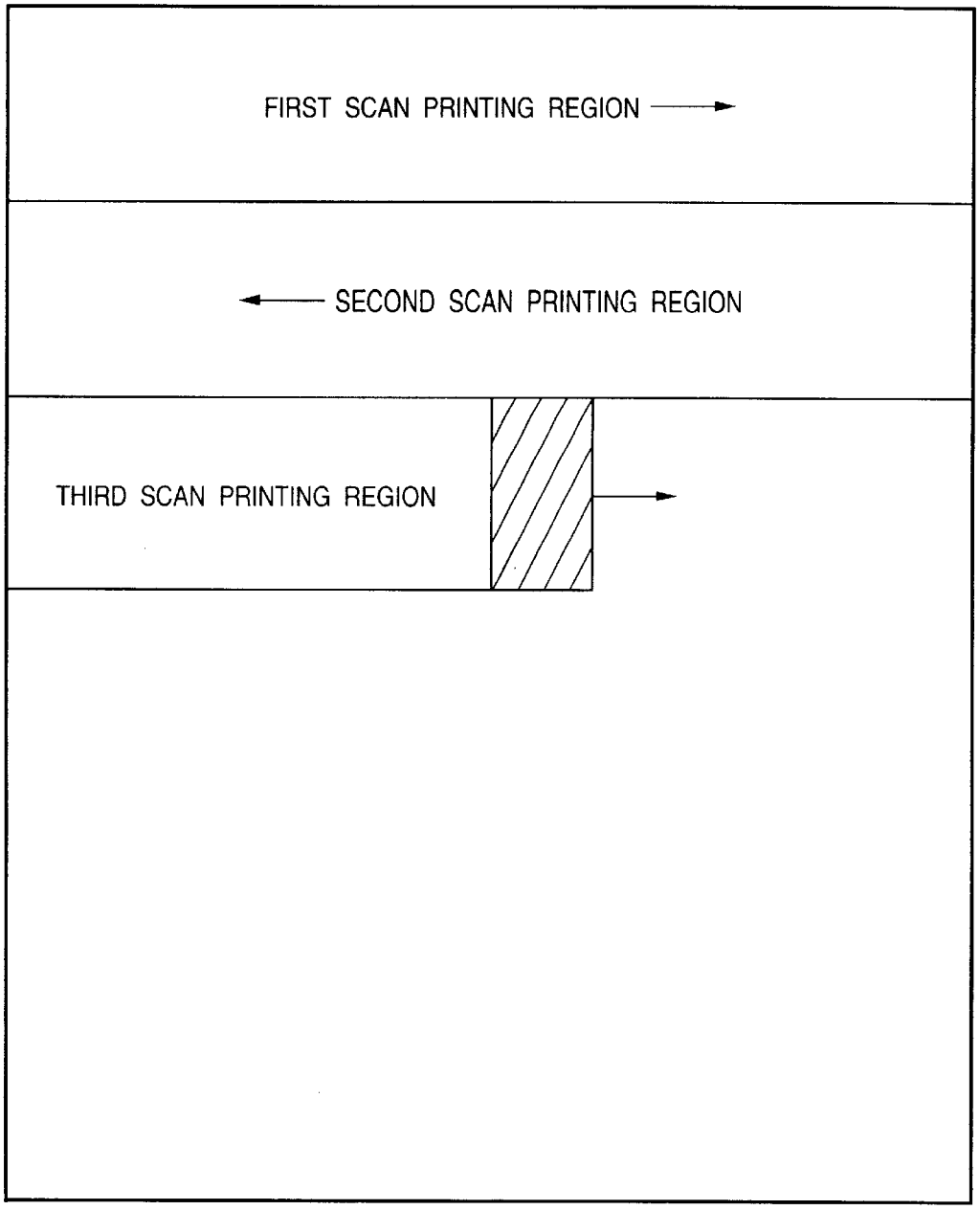
FIG. 14 is a view for explaining 1-pass two-way printing.

Even a color printer generally has a black mode in which priority is given to the speed assuming monochrome characters. In many cases, this black mode adopts not a printing method such as multipass printing in which the image quality is important, but 1-pass two-way printing. In 1-pass two-way printing, as shown in FIG. 14, data of a printing region printable by one scan is printed by one scan at once, and sheet feeding by a printing width (256 nozzles) and reciprocal printing scan are alternately repeated to complete an image. If an undischargeable nozzle exists in this mode, a white stripe on the image is continuously printed in the printing scan direction, and easily recognized. If a deviated discharge nozzle exists, the density of a deviated printing position becomes high, and a white stripe stands out.

In this case, printing data of a raster for a defective printing element that is obtained from the EEPROM 854 is completely erased. At the same time, to print this printing data by a color ink printhead at another position on the same raster, the printing data is moved to this raster. Since no printing data is stored in a printhead of another color because of the black mode, this printing can be realized.

Figure 15:
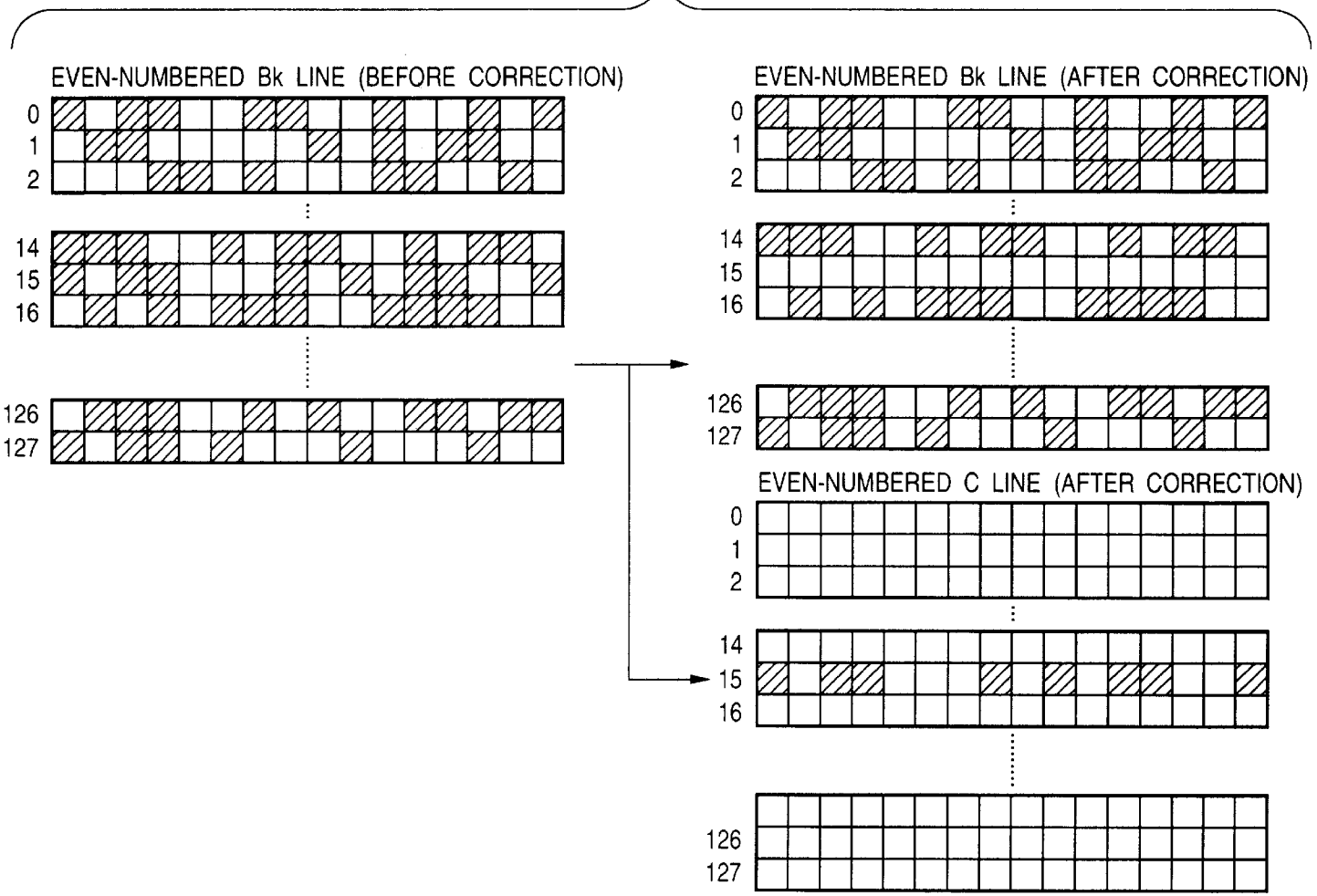
FIG. 15 is a view showing a data complementing method by 1-pass printing in the first embodiment.

In the first embodiment, as shown in FIG. 15, printing data of a raster which should be printed by the 15th nozzle of the even-numbered black nozzle line is erased. The printing data is copied to a raster corresponding to the 15th nozzle of an even-numbered cyan nozzle line. Similarly, printing data of a raster which should be printed by the 65th nozzle of the odd-numbered nozzle as a deviated discharge nozzle is erased. The same printing data as the erased printing data is copied to the raster of the 65th nozzle of an odd-numbered cyan nozzle line. By printing the moved printing data, images of cyan ink are aligned horizontally (scan direction) at positions where images should be originally printed with black ink.

However, in a printing apparatus having a high resolution of 1,200 dpi, like the first embodiment, the presence/absence of dots can be confirmed, but the color difference cannot be confirmed. Thus, it is effective for the image quality to complement omitted black printing data with cyan ink.

Figure 16:
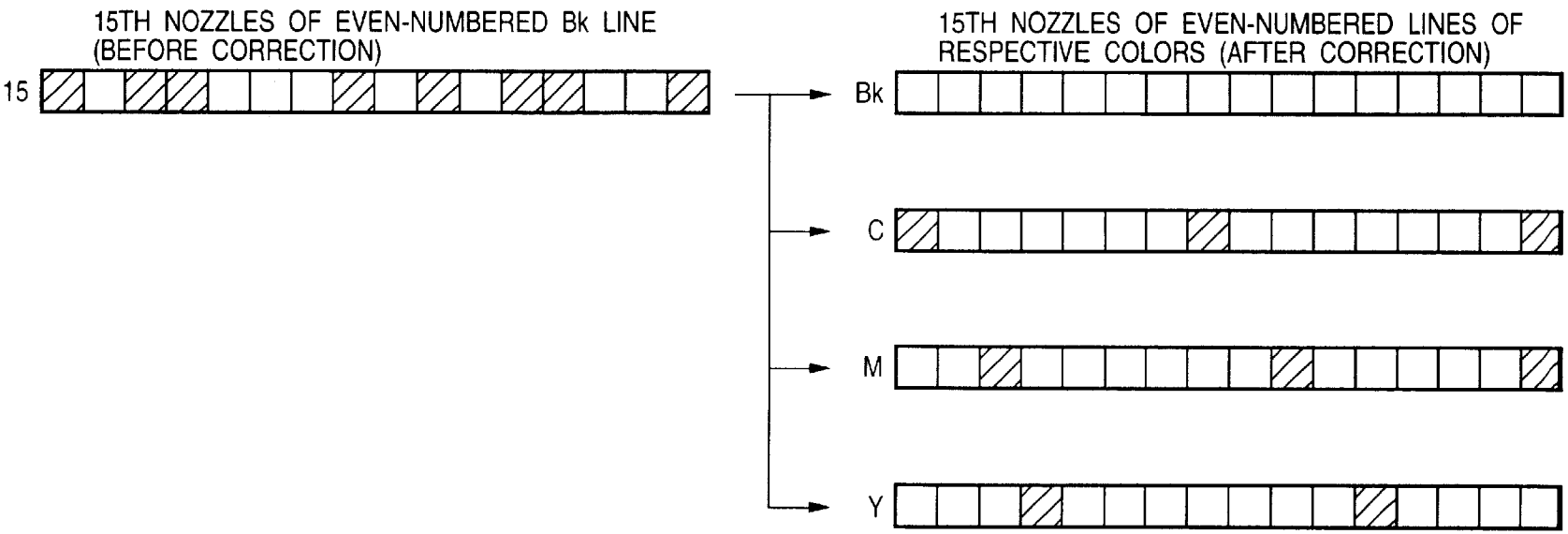
FIG. 16 is a view showing the data complementing method by 1-pass printing in the first embodiment.

In some cases, the image quality is important even in the black mode, like a monochrome photograph. Further, cyan ink which complements omitted black data may stand out depending on the printing medium. In this case, printing is completed using not only cyan ink but also other color inks. For example, since the tint of a mixture of three, cyan, yellow, and magenta color inks is close to black ink, printing data of a raster in FIG. 15 may be copied to cyan, magenta, and yellow rasters. If three color inks simultaneously print one pixel to cause ink overflow or extremely increase the density at this portion, the Bk raster may be alternately distributed to three color rasters, as shown in FIG. 16. To make the tint of the ink mixture much closer to the black tint, the printing ratio of three color inks is changed, or other light cyan and light magenta inks may be mixed. This method can be developed in many ways, and a method suitable for a printing apparatus and printing mode can be employed. In any case, image degradation by a white stripe formed by an undischargeable nozzle can be reduced. This data control may be executed by the hardware of the printing apparatus main body, or by the printer driver in the printing apparatus or in a host computer connected to the printing apparatus.

A complementing method in the color image mode of the printing apparatus will be explained.

In the color image mode, the image quality of a color photographic image is the most important. In this mode, multipass printing is done in advance. Multipass printing will be described with reference to FIG. 17.

Figure 17:
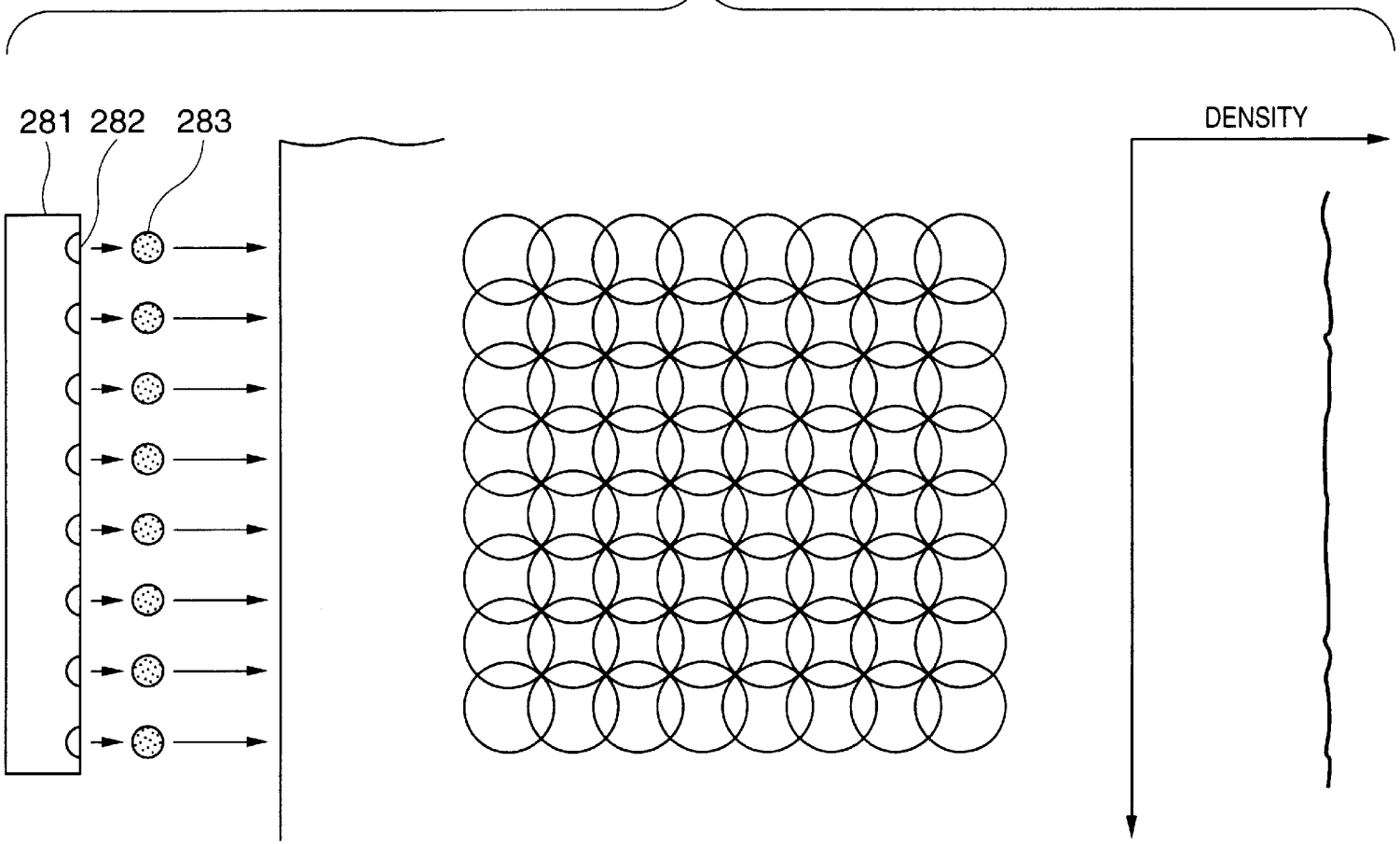
FIG. 17 is a view for explaining multipass printing.

In FIG. 17, reference numeral 281 denotes a multihead constituted by eight multiple nozzles 282 for descriptive convenience; and 283, ink droplets discharged by the multiple nozzles 282. In general, ink is ideally discharged by uniform discharge amounts in the same direction, as shown in FIG. 17. If such discharge is executed, dots of the same size are landed on a sheet surface, as shown at the center of FIG. 17, and a uniform density distribution free from any density unevenness can be attained, as shown at the right portion of FIG. 17.

Figure 18:
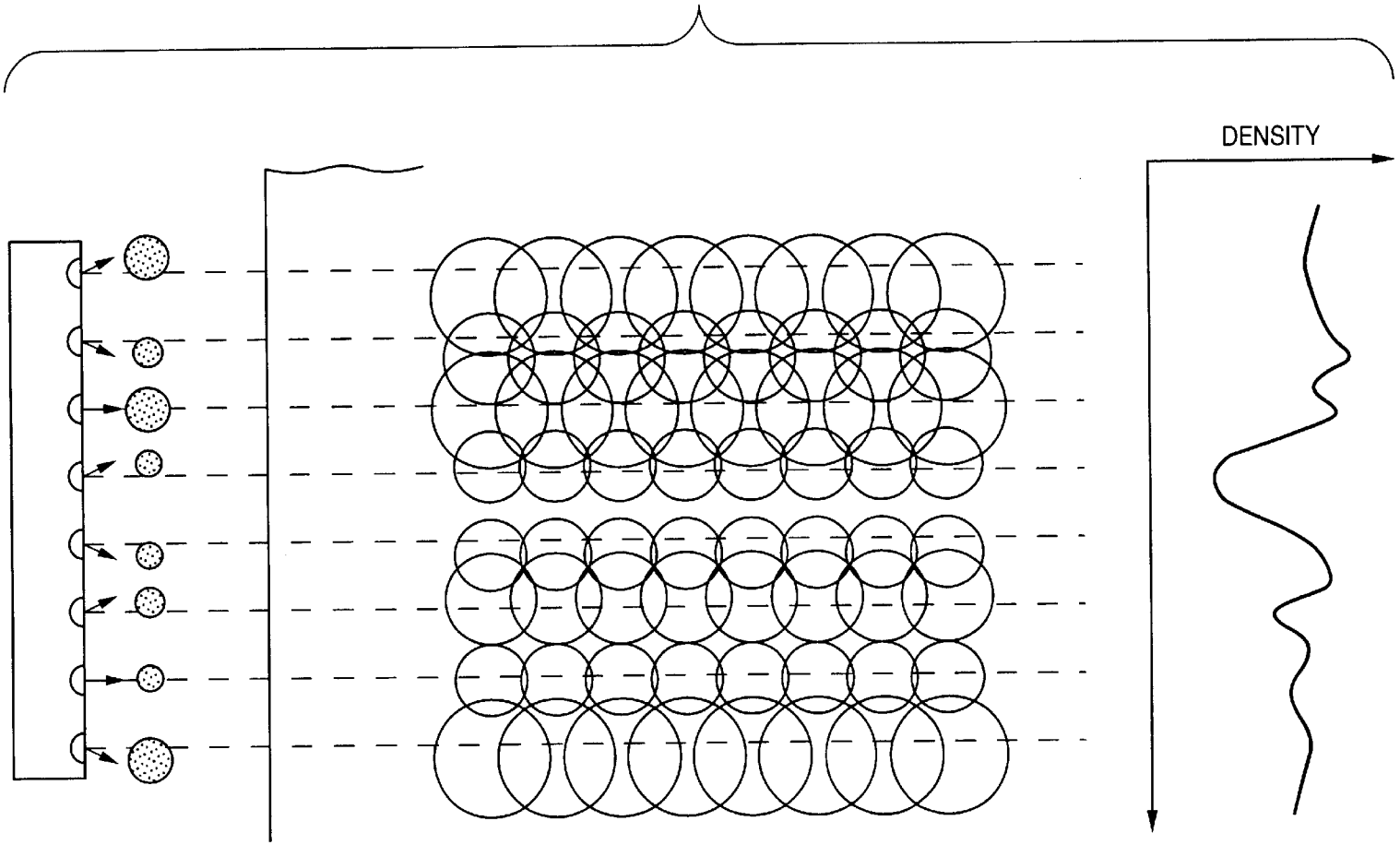
FIG. 18 is a view for explaining multipass printing.

In practice, however, nozzles vary, as described above. If printing is executed in the above manner, ink droplets discharged from nozzles vary in size and direction, as shown at the left portion of FIG. 18. These ink droplets land on a sheet surface, as shown at the center of FIG. 18. As shown in FIG. 18, a blank portion which cannot satisfy the area factor of 100% exists periodically in the main scan direction of the head, dots overlap each other more than necessary, or a white stripe like the one shown at the center of FIG. 18 appears. A set of dots which land in this state exhibit density distribution as shown on the right portion of FIG. 18 with respect to the nozzle alignment direction. These phenomena are sensed as density unevenness by the human eye.

Figure 19:
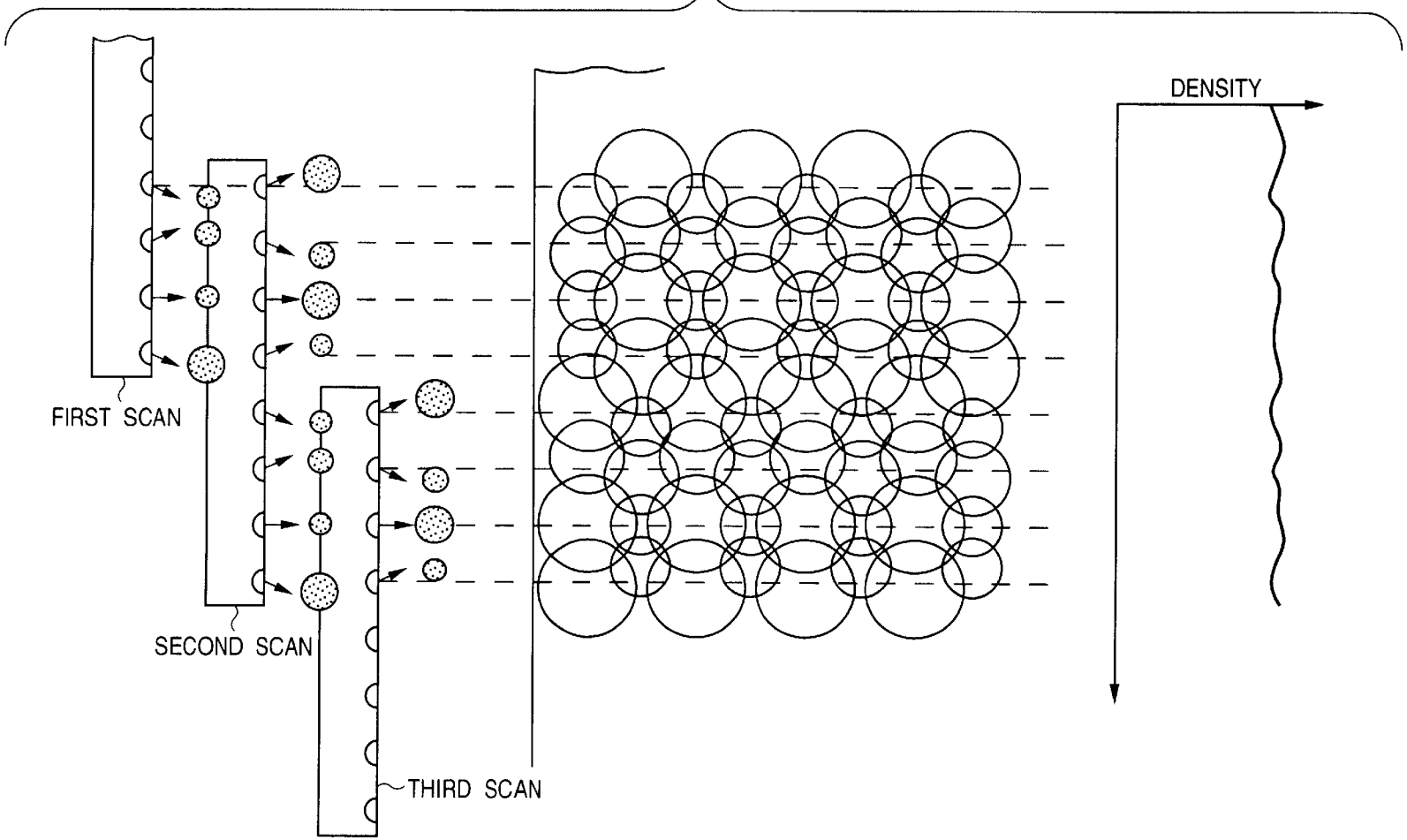
FIG. 19 is a view for explaining multipass printing.

To reduce density unevenness, a multipass printing method as shown in FIG. 19 is adopted.

According to this method, the multihead 281 is scanned three times in order to obtain a printing region shown in FIGS. 17 and 18. In this case, the eight nozzles of the multihead 281 are classified into a group of upper four nozzles and a group of lower four nozzles. A dot printed by one nozzle in one scan is substantially halved in accordance with a predetermined image data layout. The remaining half image data is printed by the second printing scan to complete printing of a region in units of four pixels. This printing method will be called multipass printing.

Using the multipass printing method can reduce influence unique to each nozzle on a printed image by half, even with a multihead identical to the one shown in FIG. 18. Thus, an image is printed as shown at the center of FIG. 19, and the black and white stripes that occur during single pass printing (as shown at the center of FIG. 18) hardly stand out. As to the density distribution, image degradation is reduced as shown at the right portion of FIG. 19, which is very effective when halftone uniformity is required, particularly for a graphic image. Two-pass printing by two divided passes has been described using eight nozzles for convenience. As the division number increases, the image quality increases, but the throughput decreases. The number of passes is appropriately designed in accordance with the intended use.

Multipass printing reduces a white stripe formed by an undischargeable nozzle and image disturbance generated by a deviated discharge nozzle, compared to an image printed by 1-pass printing. Japanese Patent Laid-Open No. 5-309874 uses this effect. However, the resultant image quality is insufficient in the field where an image quality equivalent to a silver halide photograph is required.

The first embodiment adopts 4-pass printing as a standard, and complements an undischargeable nozzle and deviated discharge nozzle by other nozzles. In this color image mode, as well as the black mode, printing data of a defective printing element that is obtained from the EEPROM 854 is erased. In this case, the copying destination of the printing data is a nozzle in another printing region of the same color head. For example, in 4-pass printing, 128 nozzles on one line of a head are classified into four blocks in units of 128/4=32 nozzles. The above-mentioned multipass printing method completes printing while complementing printing data of the same raster by four nth nozzles in the respective blocks.

For example, a raster which should be printed by the 15th nozzle of an even-numbered line in the first embodiment is complementarily printed by the 47th, 79th, and 101st nozzles in addition to the 15th nozzle. A raster which should be printed by the 65th nozzle of an odd-numbered line is complementarily printed by the first, 33rd, and 97th nozzles in addition to the 65th nozzle.

A printing data distribution method in multipass printing of the first embodiment will be explained with reference to FIG. 20.

Figure 20:
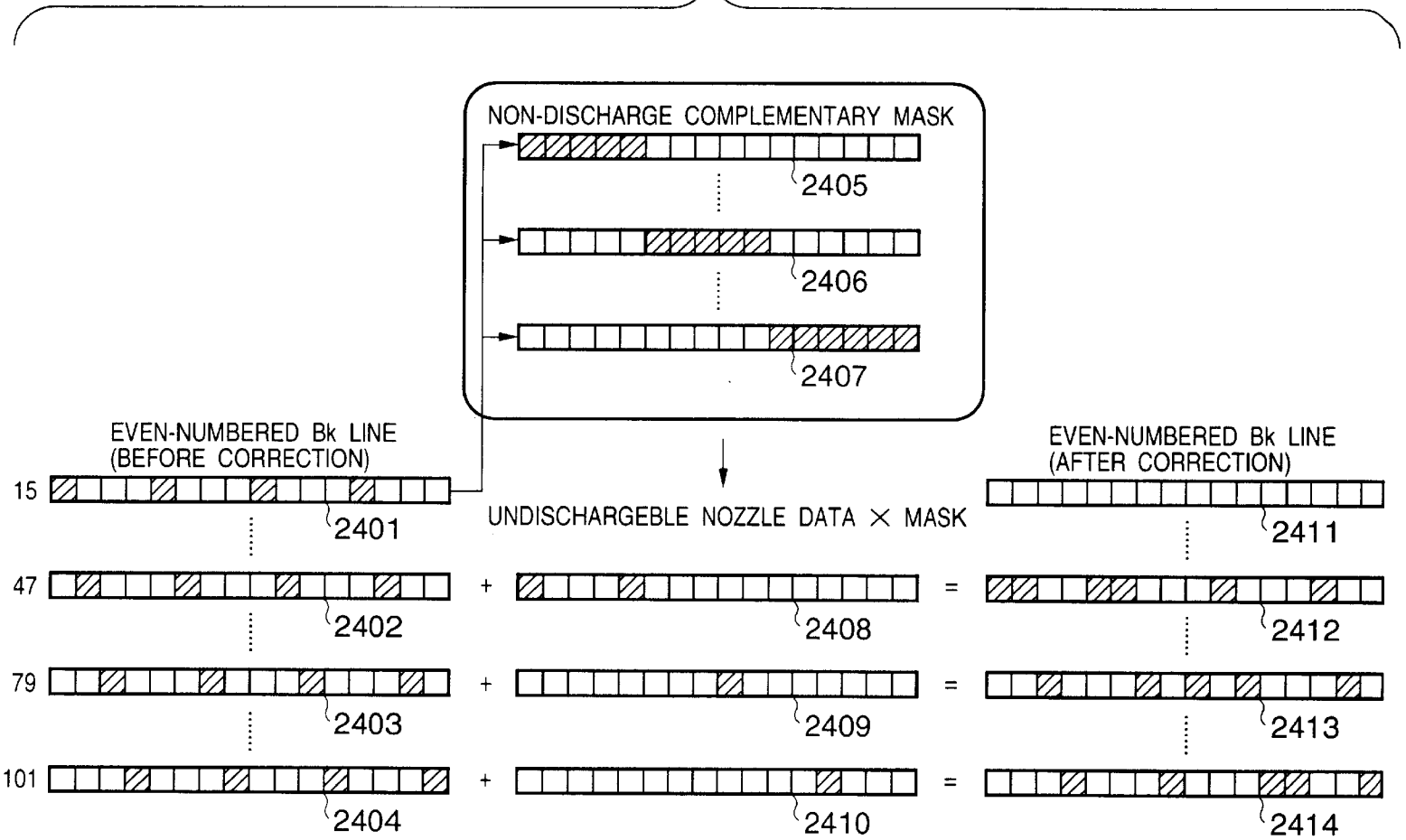
FIG. 20 is a view showing a printing data distribution method in multipass printing of the first embodiment.

FIG. 20 is a view showing the printing data distribution method in multipass printing of the first embodiment.

A non-discharge complementary mask of 16 columns is held separately from a normal printing mask. The normal printing mask has a size as large as 256×256 pixels, whereas the non-discharge complementary mask has a size as small as 1 raster×16 columns. Reference numerals 2401 to 2404 denote printing data of respective nozzles corresponding to respective scanning operations when a target raster is printed by four scanning operations. These printing data are complemented with each other, and overlapped to complete an original image.

For example, the printing data 2401 of the 15th nozzle of an even-numbered line is erased from the raster of the 15th nozzle when the 15th nozzle is confirmed to be unprintable. At the same time, the printing data 2401 is distributed to 4-pass non-discharge complementary masks (2405 to 2407). The three masks are complementary with each other, and all columns are necessarily ON (printed) on any masks. In FIG. 20, black portions represent "ON (printed)". The printing data 2401 and the non-discharge complementary masks are ANDed to extract data 2408 to 2410.

These data represent printing data which should be newly printed by the 47th, 79th, and 101st nozzles instead of the 15th nozzle. Hence, the final printing data of the 15th, 47th, 79th, and 101st nozzles are printing data 2411 to 2414 attained by ORing the data 2402 and 2408, the data 2403 and 2409, and the data 2404 and 2410. As a result, printino data of the target raster is divisionally printed by the three nozzles.

Although 4-pass printing has been exemplified, this method can be realized by any multipass printing regardless of the number of passes. A raster which should be printed by a defective nozzle is distributed to three passes for 4-pass printing, one pass for 2-pass printing, seven passes for 8-pass printing, . . . , and an image is formed by printing scan always using passes smaller in number by one than another raster. Since data is not omitted only with a smaller number of passes, this multipass printing improves the image quality much more than simple multipass printing.

The first embodiment has described non-discharge complementing methods in the two modes by exemplifying a black defective printing element. The first embodiment is also effective for a defective printing element of another color and for a case wherein defective printing elements of a plurality of colors exist simultaneously.

Since printing data of one defective nozzle is complemented by another nozzle in the first embodiment, only one nozzle is permitted as a defective nozzle per nozzle line in order to prevent the presence of a plurality of defective nozzles in a complementary combination. However, the present invention is also effective for a case wherein a plurality of defective nozzles exist in one line so long as they do not belong to the same complementary group.

Processing executed in the first embodiment will be described with reference to FIG. 21.

Figure 21:
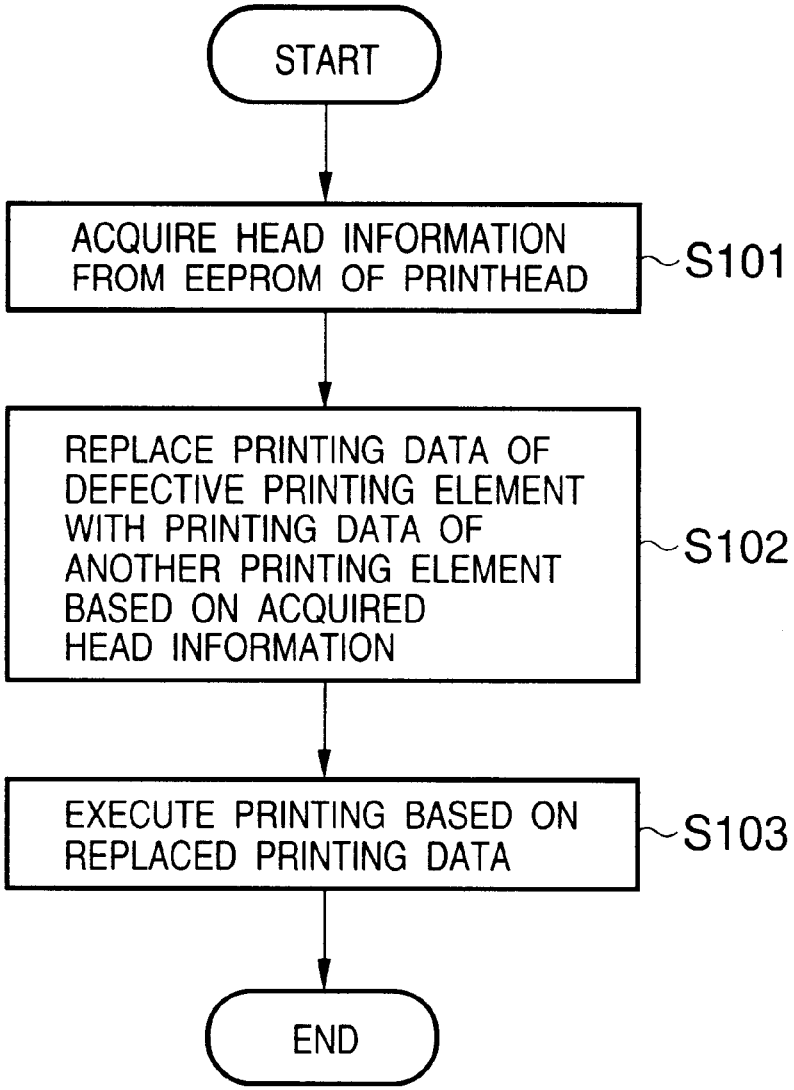
FIG. 21 is a flow chart showing processing executed in the first embodiment.

FIG. 21 is a flow chart showing processing executed in the first embodiment.

Note that the following processing is realized by the above-described main PCB (E0014) in FIG. 8.

In step S101, head information is acquired from the EEPROM 854 of the printhead. In step S102, printing data of a defective printing element is replaced with printing data of another printing element on the basis of defective printing element information in the acquired head information, which has already been described above. Printing elements for complementing printing data of the defective printing element are determined in accordance with the printing mode of the printing apparatus and the structure of the printhead.

More specifically, a representative mask pattern for masking printing data of the defective printing element and determining other nondefective printing elements used to print the printing data is stored in advance in a memory such as the EEPROM of the apparatus main body. Defective printing element information is read out from the EEPROM 854 of the printhead, and a mask pattern corresponding to the position of the defective printing element of the printhead indicated by the defective printing element information is generated with reference to the representative mask pattern stored in the memory. Printing data of the defective printing element of the printhead and printing data of other nondefective printing elements used for complementing printing of the defective printing element are replaced with new printing data on the basis of the generated mask pattern. Accordingly, omission of printing data not printed by the defective printing element can be complemented.

In step S103, printing is executed based on the replaced printing data.

In the first embodiment, the EEPROM 854 mounted in the printhead is rewritable, but is not limited to this. The first embodiment sufficiently uses a general nonvolatile memory because contents stored in the EEPROM 854 of the printhead are read-only data.

As described above, according to the first embodiment, a defective nozzle data position in shipping a printhead is stored in the EEPROM 854 of the printhead, and printing data of a defective nozzle is complementarily printed by other nozzles in each printing mode. This enables stable printing free from any white stripe regardless of the presence/absence of a defective nozzle in both 1-pass printing and multipass printing such as 4-pass printing. The user can always obtain a desired image with high image quality at a high throughput without paying attention to the state of a defective nozzle of the printhead.

Further, a printhead can be shipped even if one defective nozzle exists on each of 12 lines. This can increase the yield in shipping a head and decrease the head cost.

According to the characteristic feature of the first embodiment of the present invention, defective printing element information stored in the EEPROM 854 serving as a storage means mounted in the printhead is read by the main body apparatus, and printing data corresponding to a defective printing element of the printhead is complementarily printed by other printing elements except for the defective printing element on the basis of the read information.

<Second Embodiment>

The first embodiment has described a measure against a defective nozzle in shipment from the factory. The second embodiment will describe a measure against a defective nozzle which appears over time.

The non-discharge complementing method in the second embodiment is the same as in the first embodiment.

When the number of printing sheets is large or patterns having high printing duties are concentratedly printed, an undischargeable nozzle or deviated discharge nozzle is generated temporarily or due to the service life of the nozzle. Image degradation caused by such a nozzle is generally reduced by the above-described multipass printing, but may not be practically used by a user who requires more stable image quality. The second embodiment provides a method of printing a test pattern (nozzle check pattern) by the user periodically or if necessary, and acquiring the current status of a defective nozzle.

An example of the nozzle check pattern and a defective nozzle detection sequence (non-discharge detection mode) using the nozzle check pattern will be explained with reference to FIGS. 22 and 23.

Figure 22:
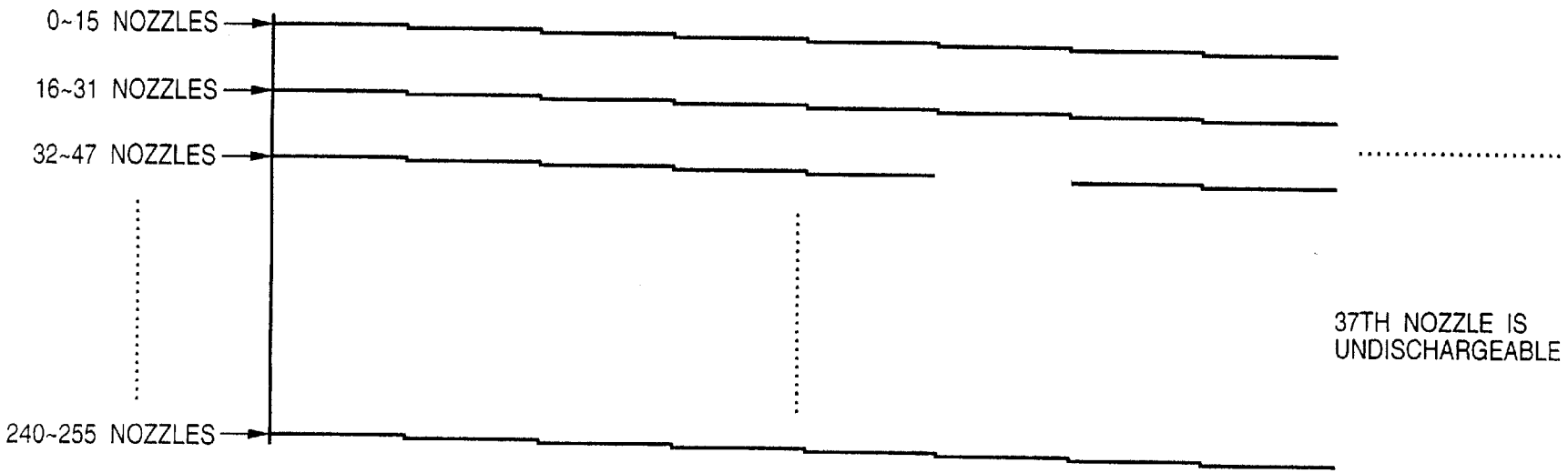
FIG. 22 is a view showing an example of a nozzle check pattern in the second embodiment.
Figure 23:
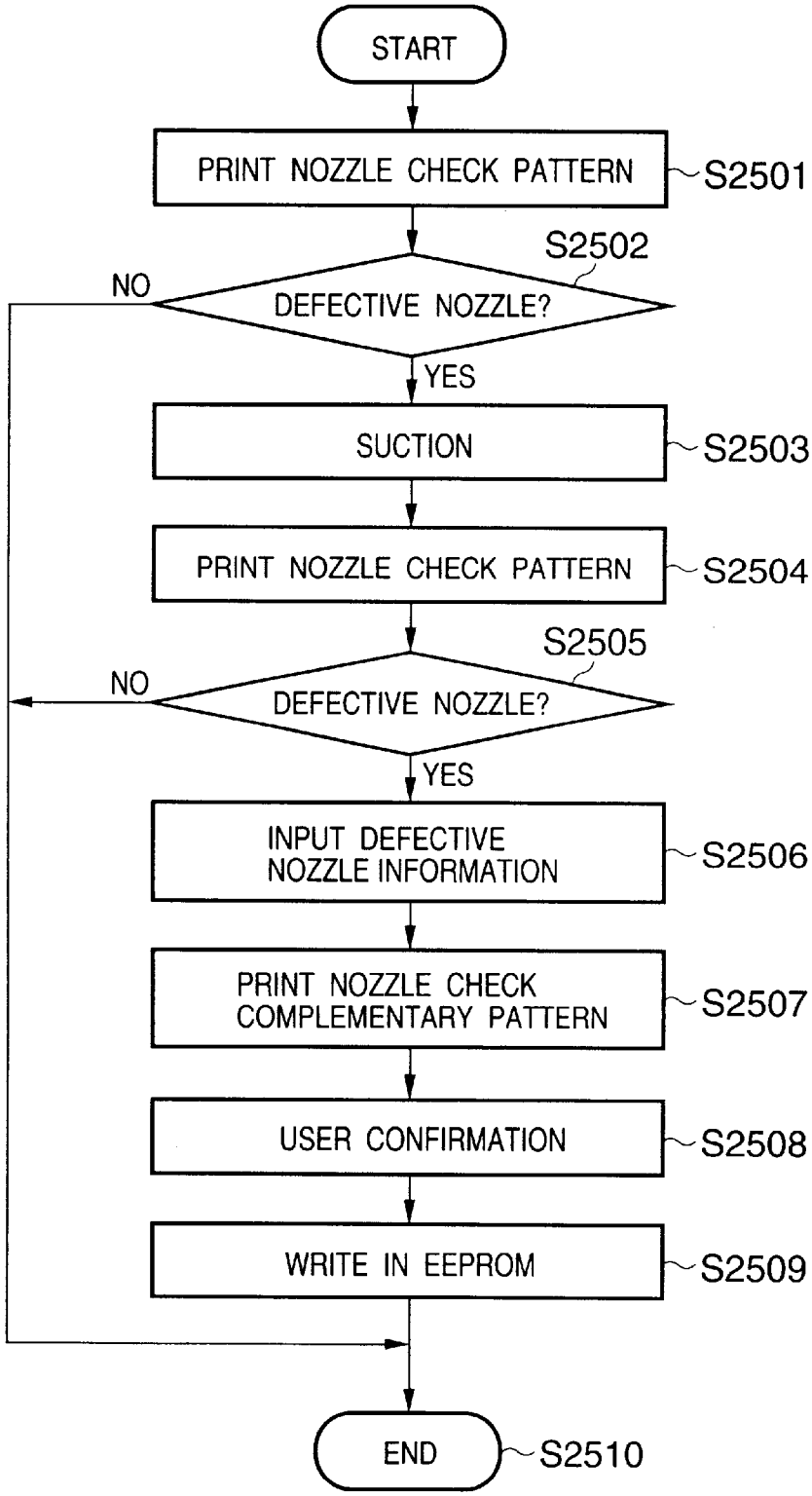
FIG. 23 is a flow chart showing a defective nozzle detection sequence in the second embodiment.

FIG. 22 is a view showing an example of the nozzle check pattern in the second embodiment, and FIG. 23 is a flow chart showing a defective nozzle detection sequence in the second embodiment.

The user prints a nozzle check pattern (FIG. 22) by a printer driver utility controlled by the printing apparatus when he/she feels that the image quality degrades, or periodically (step S2501). Note that the printer driver may be installed in a host computer connected to the printing apparatus.

As shown in FIG. 22, the nozzle check pattern represents a defective nozzle as continuous omission of a line at a predetermined portion, and allows the user to confirm the presence/absence and position of omission at a glance. In printing, such omission is prevented on an image by complementarily printing, by an adjacent nozzle, printing data of a defective nozzle which has already been stored as an undischargeable nozzle or deviated discharge nozzle in an EEPROM 854 of the printhead. The user checks the output nozzle check pattern to determine whether a defective nozzle exists. If no defective nozzle exists (NO in step S2502), the processing ends. If a defective nozzle exists (YES in step S2502), suction recovery operation is performed (step S2503).

After the completion of suction recovery operation, the user prints a nozzle check pattern again (step S2504). The user checks the output nozzle check pattern to determine whether a defective nozzle exists (step S2501). If no defective nozzle exists (NO in step S2505), the processing ends. If a defective nozzle exists (YES in step S2505), the host apparatus connected to the printing apparatus inputs the position of the defective nozzle to the printer driver with, e.g., a dedicated GUI (Graphical User Interface) (step S2506).

Figure 24:
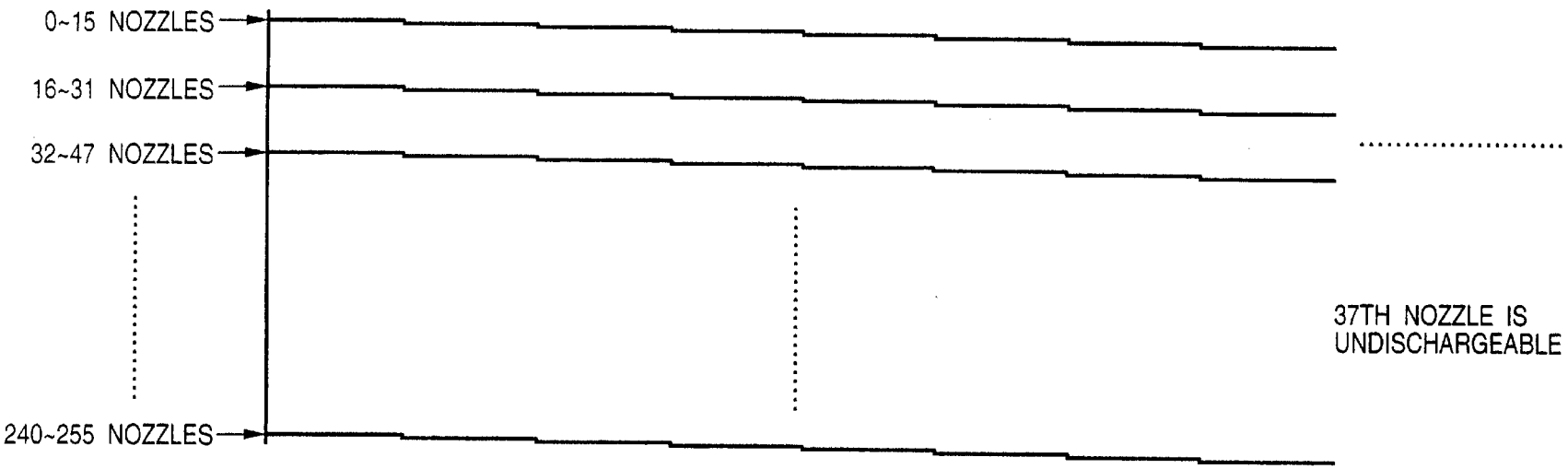
FIG. 24 is a view showing an example of a nozzle check pattern after non-discharge complementary printing in the second embodiment.

The printer driver outputs a nozzle check pattern again in accordance with nozzle number information of the input defective nozzle. The nozzle check pattern in this case is output to complement printing data at the printing position of the newly input defective nozzle by another nozzle, similar to the defective nozzle which has already been stored in the EEPROM 854. The printing result at this time is shown in FIG. 24. The user confirms that an output image is nondefective, and overwrites the newly detected defective printing element information in the main body and the EEPROM 854 of the printhead (step S2509). Since the defective printing element information is overwritten in not only the main body but also the EEPROM of the printhead, the stored defective printing element information is effectively used when the detachable printhead is mounted on another main body.

The nozzle check pattern shown in FIG. 24 can be properly output by the user in not only the non-discharge detection mode but also the utility mode of the printer driver. The user checks the nozzle check pattern, and confirms a deviated discharge state in addition to an undischargeable state to appropriately perform recovery operation or determine the exchange time of the printhead. Also in this case, complementary printing is executed by another nozzle for a defective nozzle which has already been determined to be undischargeable, as shown in FIG. 24. In FIG. 24, the 37th nozzle is undischargeable, and the 36th adjacent nozzle performs complementary printing. Alternatively, the 38th nozzle may perform complementary printing. The printhead shown in FIG. 11 may adopt a circuit arrangement using independent control methods for even- and odd-numbered nozzles. In this case, an odd-numbered undischargeable nozzle may be complemented by an odd-numbered nozzle, and an even-numbered undischargeable nozzle may be complemented by an even-numbered nozzle. In the case of FIG. 24, the 37th nozzle may be complemented by the 35th or 39th nozzle. In any case, no problem arises as long as no defect is confirmed by a user's visual check.

Figure 25:
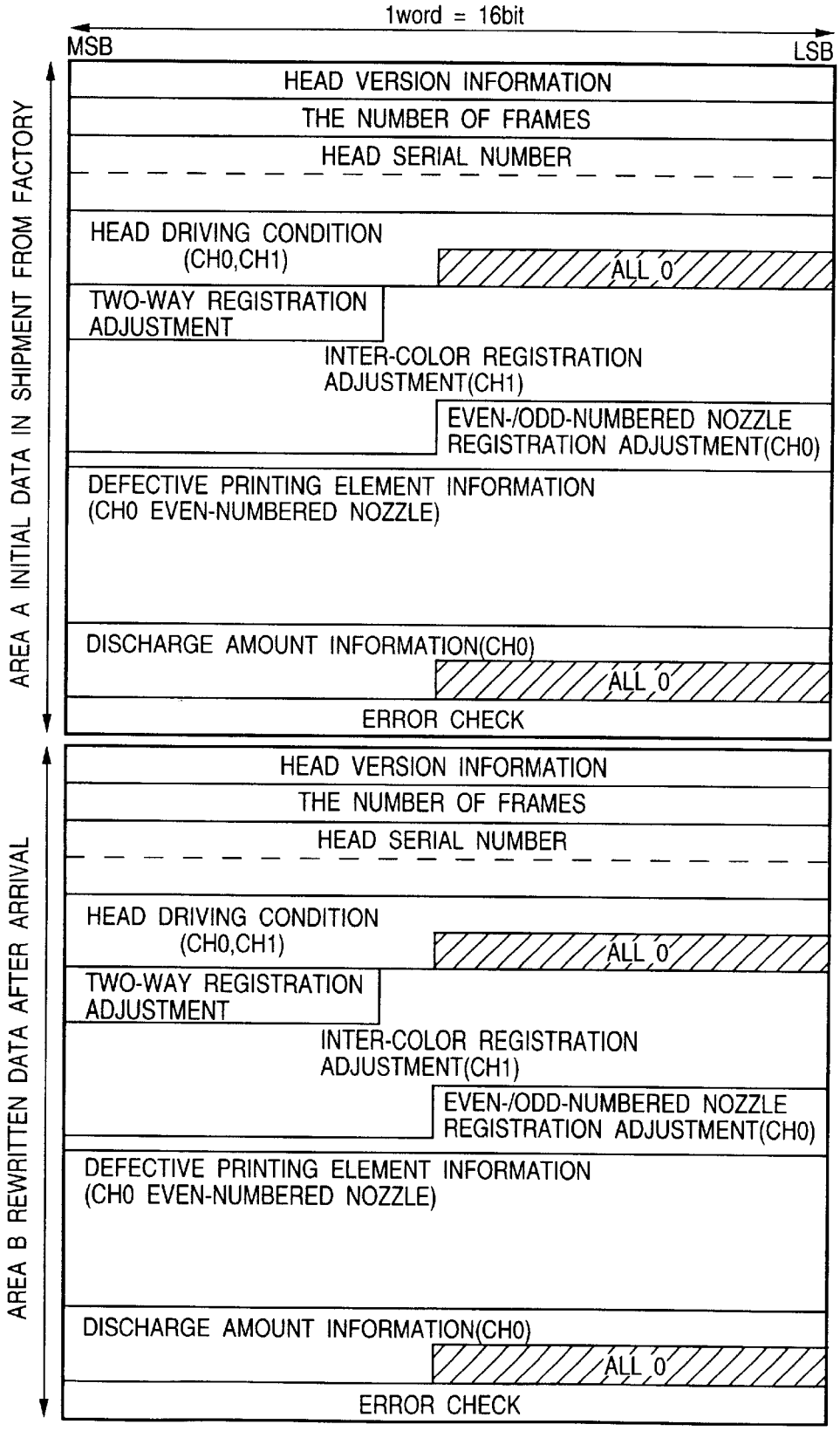
FIG. 25 is a view showing the memory contents of an EEPROM in the second embodiment.

Defective printing element information in the EEPROM 854 of the printhead may be overwritten in an area where defective printing element information has been input in shipping the printhead. In the second embodiment, as shown in FIG. 25, defective printing element information is stored in the same area B of the EEPROM 854 as in the first embodiment, and managed separately from defective printing element information input in shipment. This is because an undischargeable state caused by changes over time may be recoverable after the printhead is either left inoperative or suction is repeated several times.

In this case, in the non-discharged detection mode, only information in shipment from the factory is output when a nozzle check pattern is printed for the first time (step S2501). If a defective nozzle which was undischargeable in the previous non-discharge detection mode recovers, this nozzle can be used from this stage. Every time new defective printing element information is obtained, it is rewritten in area B of EEPROM 854 dedicated to the non-discharged detection mode. In some cases, initial data other than defective printing element information programmed at the factory prior to shipment must be saved as data which changes over time in the head information of the EEPROM 854. In the first embodiment, the same contents in shipment from the factory are always stored in areas A and B. In the second embodiment, initial data in shipment from the factory is always stored in area A, while the latest data after delivery is always stored in area B.

The second embodiment has described a method of visually checking an output nozzle check pattern by the user and manually inputting defective printing element information. However, the present invention is not limited to this. Considering a dense nozzle arrangement or yellow ink whose contrast is low, it may be difficult for the user to visually check a nozzle check pattern. In such a case, an image reading mechanism is desirably attached to the main body in advance to read an output nozzle check pattern, thereby automatically determining the presence/absence and position of a defective nozzle. The image reading mechanism may be constituted by mounting a CCD on the carriage or mounting a scanner unit on the main body carriage in place of the printhead. In the former case, the user only executes the non-discharge detection mode, and subsequent processing can automatically proceed. Since printing and reading can be done at the same position, printing is completed with only one sheet without discharging printing sheets several times. In the latter case, the printhead must be mounted on the carriage in printing a nozzle check pattern, and exchanged with a scanner unit in reading, which is inconvenient for the user. However, this enables finer, more accurate determination than the former case or a user's visual check.

In automatic processing, head information can be acquired at once not only for determination of a defective nozzle, which is the subject of the present invention, but also for items unique to the printhead which readily changes over time, such as a shift between the even- and odd-numbered lines of the printhead, a shift between colors, or a shift in two-way printing. In practice, the image quality degrades owing the various factors. It is difficult for the user to determine a single factor. For this reason, it is desirable to automatically acquire head information at once, including factors such as a non-discharge complementary factor for which correction data must be periodically created.

As described above, according to the second embodiment, not only defective nozzle data recorded prior to shipping a printhead, but also the nozzle states which change over time with use are properly rewritten in the EEPROM 854 of the printhead. Moreover, printing data of a defective nozzle is complementary printed by another nozzle in each printing mode. This realizes stable printing free from any white stripe, regardless of the presence/absence of a defective nozzle and changes over time.

The above embodiments have been explained by assuming that a droplet discharged from a printhead is ink and that a liquid contained in an ink tank is ink. However, the content of the ink tank is not limited to ink. For example, the ink tank can also contain a processing solution to be discharged onto a printing medium to increase the fixing properties, water resistance or quality of a printed image.

The above embodiments can increase the density and resolution of printing by using a system which includes a means (e.g., an electrothermal transducer or a laser beam) for generating thermal energy used to discharge ink, and causes a state change of the ink by this thermal energy, among other inkjet printing systems.

As a representative arrangement or principle, it is preferable to use the basic principle disclosed in, e.g., U.S. Pat. No. 4,723,129 or U.S. Pat. No. 4,740,796. This system is applicable to both a so-called on-demand apparatus and a so-called continuous apparatus. The system is particularly effective in an on-demand apparatus because at least one driving signal corresponding to printing information and giving a rapid temperature rise exceeding nucleate boiling is applied to an electrothermal transducer which corresponds to a sheet or channel holding a liquid (ink), thereby causing this electrothermal transducer to generate thermal energy and cause film boiling on the thermal action surface of a printhead. Consequently, a bubble can be formed in the liquid (ink) in one-to-one correspondence with the driving signal. By growth and shrinkage of this bubble, the liquid (ink) is discharged from a discharge orifice to form at least one droplet. This driving signal is more preferably a pulse signal because growth and shrinkage of a bubble are instantaneously appropriately performed, so discharge of the liquid (ink) having high response is achieved.

This pulse driving signal is preferably a signal described in U.S. Pat. No. 4,463,359 or U.S. Pat. No. 4,345,262. Note that superior printing can be performed by the use of conditions described in U.S. Pat. No. 4,313,124 which concerns the rate of temperature rise on the thermal action surface.

The arrangement of a printhead can be the combination (a linear liquid channel or a right-angle liquid channel) of the discharge orifices, liquid channels, and electrothermal transducers disclosed in the specifications described above. The present invention also includes arrangements using U.S. Pat. Nos. 4,558,333 and 4,459,600 in each of which the thermal action surface is placed on a bent region. Additionally, it is possible to use an arrangement based on Japanese Patent Laid-Open No. 59-123670 in which a common slot is used as a discharge portion of a plurality of electrothermal transducers or Japanese Patent Laid-Open No. 59-138461 in which an opening for absorbing the pressure wave of thermal energy is opposed to a discharge portion.

Furthermore, a full line type printhead having a length corresponding to the width of the largest printing medium printable by a printing apparatus can have a structure which meets this length by combining a plurality of printheads as disclosed in the aforementioned specifications or can be a single integrated printhead.

In addition, it is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or a preliminary means for a printhead to the printing apparatus described above is preferable because printing can be further stabilized. Practical examples of the additional means for a printhead are a capping means, a cleaning means, a pressurizing or drawing means, an electrothermal transducer or another heating element, or a preliminary heating means combining them. A predischarge mode for performing discharge different from printing is also effective to perform stable printing.

A printing mode of the printing apparatus is not restricted to a printing mode using only a main color such as black. That is, the apparatus can have at least a composite color mode using different colors and a full color mode using mixed colors, regardless of whether a printhead is an integrated head or the combination of a plurality of heads.

The above embodiments are explained assuming that ink is a liquid. However, it is possible to use ink which solidifies at room temperature or less but softens or liquefies at room temperature. In inkjet systems, the general approach is to perform temperature control such that the viscosity of ink falls within a stable discharge range by adjusting the temperature of the ink itself within the range of 30° C. to 70° C. Hence, ink need only be a liquid when a printing signal used is applied to it.

Additionally, to positively prevent a temperature rise by thermal energy by positively using this temperature rise as energy of the state change from the solid state to the liquid state of ink, or to prevent evaporation of ink, ink which solidifies when left to stand and liquefies when heated can be used. That is, the present invention is applicable to any ink which liquefies only when thermal energy is applied, such as ink which liquefies when applied with thermal energy corresponding to a printing signal and is discharged as liquid ink, or ink which already starts to solidify when arriving at a printing medium. As described in Japanese Patent Laid-Open No. 54-56847 or 60-71260, this type of ink can be;held as a liquid or solid in a recess or through hole in a porous sheet and opposed to an electrothermal transducer in this state. In the present invention, executing the aforementioned film boiling scheme is most effective for each ink described above.

Furthermore, the printing apparatus according to the present invention can take the form of any of an integrated or separate image output terminal of an information processing apparatus such as a computer, a copying apparatus combined with a reader or the like, and a facsimile apparatus having a transmission/reception function.

The present invention can be applied to a system constituted by a plurality of devices (e.g., a host computer, interface, reader, and printer) or to an apparatus (e.g., a copying machine or facsimile apparatus) comprising a single device.

Further, the object of the present invention can also be achieved by providing a storage medium which stores software program codes for performing the aforesaid functions according to the embodiments to a system or an apparatus, reading the program codes with a computer (or a CPU or MPU) of the system or apparatus form the storage medium, and then executing the program codes.

In this case, the program codes read out from the storage medium realize the functions according to the embodiments, and the storage medium storing the program codes constitutes the invention.

Further, as the storage medium for providing the program codes, it is possible to use, e.g., a floppy disk, hard disk, optical disk, magnetooptical disk, CD-ROM, CD-R, magnetic tape, nonvolatile memory card, and ROM.

Furthermore, besides aforesaid functions according to the above embodiments are realized by executing the program codes which are read out by a computer, the present invention includes a case where an OS (Operating System) or the like running on the computer performs a part or the whole of actual processing in accordance with designations by the program codes and realizes functions according to the above embodiments.

Furthermore, the present invention also includes a case where, after the program codes read out from the storage medium are written in a memory of a function extension board inserted into a computer or of a function extension unit connected to a computer, a CPU or the like of the function extension board or function extension unit performs a part or the whole of actual processing in accordance with designations by the program codes and realizes functions of the above embodiments.

When the present invention is applied to the above storage medium, this storage medium stores program codes corresponding to the flow chart shown in FIG. 21 or 23 explained earlier.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing using a printhead with a plurality of printing elements, comprising:

reading means for reading information from storage means which is arranged on the printhead to store information regarding a defective printing element of the printhead;

writing means for writing information, regarding a defective printing element of the printhead when the defective printing element is detected, to the storage means;

determination means for determining a complementary printing element for masking printing data corresponding to each defective printing element indicated by the defective printing element information read by said reading means and complementarily printing the printing data corresponding to the defective printing element, wherein the masking printing data is formed on a printing position by a printing element, and a complementary printing element is determined for each defective printing element; and printing means for printing the printing data of each defective printing element on a printing position corresponding to the defective printing element using the complementary printing element determined by said determination means, wherein said determination means determines as the complementary printing element a printing element belonging to the same printing element line for performing printing with ink of the same color as the defective printing element, and said printing means prints the printing data of the defective printing element using the complementary printing element in a printing scan different from the printing scan in which the defective printing element should print the printing data.

2. The apparatus according to claim 1, wherein the defective printing element information is detected in a predetermined printing mode and stored in said storage means after the printing apparatus and the printhead are delivered.

3. The apparatus according to claim 1, wherein said storage means comprises a first area where the defective printing element information in shipment from a factory is stored, and a second storage area where defective printing element information detected in a predetermined printing mode is stored after the printing apparatus and the printhead are delivered.

4. The apparatus according to claim 1, wherein said determination means determines as the complementary printing element a printing element parallel to the defective printing element in a printing scan direction of the printhead.

5. The apparatus according to claim 1, wherein when the printing apparatus has a plurality of printing modes, said determination means determines in accordance with a designated printing mode a complementary printing element for masking the printing data of the defective printing element indicated by the defective printing element information and performing complementary printing of the printing data.

6. A control method for a printing apparatus for performing printing using a printhead with a plurality of printing elements, comprising:

a reading step of reading information from a storage medium which is arranged on the printhead to store information regarding a defective printing element of the printhead;

a writing step of writing information, regarding a defective printing element of the printhead when the defective printing element is detected, to the storage medium;

a determination step of determining a complementary printing element for masking printing data corresponding to each defective printing element indicated by the defective printing element information read in the reading step and complementarily printing the printing data corresponding to the defective printing element, wherein the masking printing data is formed on a printing position by a printing element, and a complementary printing element is determined for each defective printing element; and a printing step of printing the printing data of each defective printing element on a printing position corresponding to the defective printing element using the complementary printing element determined in the determination step, wherein the determination step comprises determining as the complementary printing element a printing element belonging to the same printing element line for performing printing with ink of the same color as the defective printing element, and the printing step comprises printing the printing data of the defective printing element using the complementary printing element in a printing scan different from the printing scan in which the defective printing element should print the printing data.

7. The method according to claim 6, wherein the defective printing element information is detected in a predetermined printing mode and stored in the storage medium after the printing apparatus and the printhead are delivered.

8. The method according to claim 6, wherein the storage medium comprises a first area where the defective printing element information in shipment from a factory is stored, and a second storage area where defective printing element information detected in a predetermined printing mode is stored after the printing apparatus and the printhead arrive.

9. The method according to claim 6, wherein the determination step comprises determining as the complementary printing element a printing element parallel to the defective printing element in a printing scan direction of the printhead.

10. The method according to claim 6, wherein the determination step comprises, when the printing apparatus has a plurality of printing modes, determining in accordance with a designated printing mode a complementary printing element for masking the printing data of the defective printing element indicated by the defective printing element information and performing complementary printing of the printing data.

11. A computer-readable memory storing program codes of control of a printing apparatus for performing printing using a printhead with a plurality of printing elements, comprising:

a program code of a reading step of reading information from a storage medium which is arranged on the printhead to store information regarding a defective printing element of the printhead;

a program code of a writing step of writing information, regarding a defective printing element of the printhead when the defective printing element is detected, to the storage medium;

a program code of a determination step of determining a complementary printing element for masking printing data corresponding to each defective printing element indicated by the defective printing element information read in the reading step and complementarily printing the printing data corresponding to the defective printing element, wherein the masking printing data is formed on a printing position by a printing element, and a complementary printing element is determined for each defective printing element; and a program code of a printing step of printing the printing data of each defective printing element on a printing position corresponding to the defective printing element using the complementary printing element determined in the determination step, wherein the determination step comprises determining as the complementary printing element a printing element belonging to the same printing element line for performing printing with ink of the same color as the defective printing element, and the printing step comprises printing the printing data of the defective printing element using the complementary printing element in a printing scan different from the printing scan in which the defective printing element should print the printing data.

* * * * *

UNITED STATES PATENT AND TRADEMARK OFFICE

CERTIFICATE OF CORRECTION

PATENT NO. : 6,733,100 B1
DATED : May 11, 2004
INVENTOR(S) : Fujita et al.

It is certified that error appears in the above-identified patent and that said Letters Patent is hereby corrected as shown below:

Drawings,
Sheet 20, Fig. 20, "UNDISCHARGEBLE" should read -- UNDISCHARGEABLE --.

Column 2,
Line 7, "application" should read -- application of --.
Line 10, "discloses" should read -- disclosed --.

Column 3,
Line 3, "Printhead" should read -- Printheads --.

Column 6,
Line 8, "increased a" should read -- increased and --.

Column 7,
Line 62, "level" should read -- lever --.

Column 10,
Line 58, "clock" should read -- clock signals --.

Column 18,
Line 37, "printino" should read -- printing --.

Column 22,
Line 21, "complementary" should read -- complementarily --.

Column 23,
Line 58, "be;held" should read -- be held --.

Signed and Sealed this

Twenty-ninth Day of March, 2005

JON W. DUDAS
*Director of the United States Patent and Trademark Office*